US011328650B2

(12) United States Patent
Yang et al.

(10) Patent No.: US 11,328,650 B2
(45) Date of Patent: May 10, 2022

(54) DRIVER, DISPLAY DEVICE AND OPTICAL COMPENSATION METHOD

(71) Applicants: Beijing BOE Display Technology Co., Ltd., Beijing (CN); BOE TECHNOLOGY GROUP CO., LTD., Beijing (CN)

(72) Inventors: Yan Yang, Beijing (CN); Chinghua Hung, Beijing (CN); Wenchieh Huang, Beijing (CN); Rui Liu, Beijing (CN); Wei Sun, Beijing (CN); Ming Chen, Beijing (CN)

(73) Assignees: Beijing BOE Display Technology Co., Ltd., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 74 days.

(21) Appl. No.: 16/960,137

(22) PCT Filed: Sep. 30, 2019

(86) PCT No.: PCT/CN2019/109381

§ 371 (c)(1),
(2) Date: Jul. 6, 2020

(87) PCT Pub. No.: WO2021/062604

PCT Pub. Date: Apr. 8, 2021

(65) Prior Publication Data

US 2021/0407370 A1 Dec. 30, 2021

(51) Int. Cl.
*G09G 3/20* (2006.01)

(52) U.S. Cl.
CPC ..... *G09G 3/2074* (2013.01); *G09G 2310/08* (2013.01); *G09G 2320/0233* (2013.01); *G09G 2320/0693* (2013.01); *G09G 2360/16* (2013.01)

(58) Field of Classification Search
CPC ..... G09G 3/2074; G09G 2310/08; G09G 2320/0233; G09G 2360/16
See application file for complete search history.

(56) References Cited

U.S. PATENT DOCUMENTS 9,299,318 B2 3/2016 Oh et al.
10,290,271 B2 5/2019 Lv
(Continued)

FOREIGN PATENT DOCUMENTS

CN 106228943 A 12/2016
CN 106297644 A 1/2017
(Continued)

OTHER PUBLICATIONS

Written Opinion for International Application No. PCT/CN2019/109381 dated Jun. 24, 2020.

*Primary Examiner* — Gene W Lee
(74) *Attorney, Agent, or Firm* — Thomas | Horstemeyer, LLP

(57) ABSTRACT

A driver, a display device, and an optical compensation method thereof are provided. The display panel includes sub-pixels arranged in an array. The method includes: receiving an initial gray level of each sub-pixel of a picture to be displayed; determining whether each sub-pixel satisfies a preset determination condition based on the initial gray level of each sub-pixel; if an absolute value of a difference between the initial gray levels of two sub-pixels electrically connected to a same data line and located in two adjacent rows is greater than a preset threshold, it is determined that a sub-pixel in a next row satisfies the preset determination condition; and, in response to determining that a sub-pixel satisfies the preset determination condition, acquiring a first compensation parameter of the sub-pixel, and compensating the initial gray level of the sub-pixel based on the acquired first compensation parameter.

19 Claims, 10 Drawing Sheets

(56) References Cited

U.S. PATENT DOCUMENTS

| | | | | |
|---|---|---|---|---|
| 10,607,528 | B2 | 3/2020 | Zeng | |
| 2007/0200811 | A1* | 8/2007 | So | G09G 3/3648 345/89 |
| 2013/0113848 | A1* | 5/2013 | Bae | G09G 3/3688 345/87 |
| 2013/0135365 | A1* | 5/2013 | Ito | G09G 3/3648 345/690 |
| 2014/0320521 | A1 | 10/2014 | Oh et al. | |
| 2017/0345383 | A1* | 11/2017 | Yin | G09G 3/3688 |
| 2018/0308438 | A1 | 10/2018 | Lv | |
| 2019/0027085 | A1 | 1/2019 | Zeng | |
| 2019/0140030 | A1 | 5/2019 | Huangfu et al. | |
| 2020/0119107 | A1 | 4/2020 | Liu et al. | |
| 2022/0005425 | A1* | 1/2022 | Wang | G09G 3/3611 |

FOREIGN PATENT DOCUMENTS

| | | | |
|---|---|---|---|
| CN | 106842752 | A | 6/2017 |
| CN | 106847157 | A | 6/2017 |
| CN | 107170419 | A | 9/2017 |
| CN | 106228943 | B | 11/2018 |
| CN | 109584796 | A | 4/2019 |
| CN | 109979385 | A | 7/2019 |
| CN | 110134353 | A | 8/2019 |
| CN | 106847157 | B | 1/2020 |
| KR | 20080040253 | A | 5/2008 |

* cited by examiner

DRIVER, DISPLAY DEVICE AND OPTICAL COMPENSATION METHOD

CROSS-REFERENCE TO RELATED APPLICATION

The present application a national phase application under 35 U.S.C. § 371 of International Patent Application No. PCT/CN2019/109381 filed on Sep. 30, 2019, where the contents of which are hereby incorporated by reference in its entirety herein.

TECHNICAL FIELD

The present disclosure relates to the field of display technologies and, in particular, to a driver, a display device, and an optical compensation method thereof.

BACKGROUND

Active driving technologies are widely used in the display field that adopt a pixel driving circuit containing thin film transistors to control each sub-pixel to emit light independently. However, as a refresh rate and a size of the display panel continue to increase, a charging time for each sub-pixel becomes shorter and shorter. In particular, when the display panel displays a heavy-loaded picture, each sub-pixel is prone to insufficient charging which degrades the display effect of the display panel.

It should be noted that the information disclosed in the Background section above is only for enhancing the understanding of the background of the present disclosure, and thus, may include information that does not constitute prior art known to those of ordinary skill in the art.

SUMMARY

The present disclosure aims to provide a driver, a display device, and an optical compensation method thereof to improve a charging rate for sub-pixels.

In order to achieve the above object of the present disclosure, the present disclosure adopts the following technical solutions.

According to a first aspect of the present disclosure, there is provided an optical compensation method for a display device, where the display device includes a driver and a display panel. The display panel includes a plurality of sub-pixels arranged in an array, and the optical compensation method includes: receiving an initial gray level of each of the sub-pixels of a picture to be displayed; determining whether each of the sub-pixels satisfies a preset determination condition based on the initial gray level of each of the sub-pixels; if an absolute value of a difference between the initial gray levels of two sub-pixels electrically connected to a same data line and located in two adjacent rows is greater than a preset threshold, it is determined that the sub-pixel in a next row satisfies the preset determination condition; and in response to determining that a sub-pixel satisfies the preset determination condition, acquiring a first compensation parameter of the sub-pixel, and compensating the initial gray level of the sub-pixel based on the acquired first compensation parameter.

In an exemplary embodiment of the present disclosure, in the display panel, the sub-pixels in a same column are connected to a same data line; it is determined whether any sub-pixel in the next row satisfies the preset determination condition by: calculating the absolute value of the difference between the initial gray levels of the sub-pixel in the next row and the sub-pixel in a previous row; and determining that the sub-pixel in the next row satisfies the preset determination condition if the absolute value of the difference is greater than the preset threshold.

In an exemplary embodiment of the present disclosure, in the display panel, a sub-pixel P(i, 2j) and a sub-pixel P(i+1, 2j−1) are connected to a data line L(i+1), where the data line L(i+1) is the (i+1)th data line, the sub-pixel P(i, 2j) is a sub-pixel located in a i-th column and the 2j-th row, the sub-pixel P(i+1, 2j−1) is a sub-pixel located in a (i+1)th column and a (2j−1)th row, where i is a positive integer greater than 0 and j is a positive integer greater than 0;

According to the initial gray level of each sub-pixel, determining whether each sub-pixel satisfies a preset determination condition includes: calculating an absolute value of a difference between G(i, 2j) and G(i+1, 2j−1), if the absolute value of the difference between G(i, 2j) and G(i+1, 2j−1) is greater than the preset threshold, determining that the sub-pixel P(i, 2j) satisfies the preset determination condition; calculating an absolute value of a difference between G(i+1, 2j+1) and G(i, 2j), if the absolute value of the difference between G(i+1, 2j+1) and G(i, 2j) is greater than the preset threshold, determining that the sub-pixel P(i+1, 2j+1) satisfies the preset determination condition; where, G(i, 2j) is the initial gray level of the sub-pixel P(i, 2j), and G(i+1, 2j−1) is the initial gray level of the sub-pixel P(i+1, 2j−1), G(i+1, 2j+1) is the initial gray level of the sub-pixel P(i+1, 2j+1).

In an exemplary embodiment of the present disclosure, in the display panel, a sub-pixel P(i, 2j−1) and a sub-pixel P(i+1, 2j) are connected to the data line L(i+1), where the data line L(i+1) is the (i+1)th data line, the sub-pixel P(i, 2j−1) is a sub-pixel located in the i-th column and the (2j−1)th row, sub-pixel P(i+1, 2j) is a sub-pixel located in the (i+1)th column and the 2j-th row, where i is a positive integer greater than 0 and j is a positive integer greater than 0;

According to the initial gray level of each sub-pixel, determining whether each sub-pixel satisfies a preset determination condition includes: calculating an absolute value of a difference between G(i+1, 2j) and G(i, 2j−1), if the absolute value of the difference between G(i+1, 2j) and G(i, 2j−1) is greater than the preset threshold, determining that the sub-pixel the sub-pixel P(i+1, 2j) satisfies the preset determination condition; calculating an absolute value of a difference between G(i, 2j+1) and G(i+1, 2j), if the absolute value of the difference between G(i, 2j+1) and G(i+1, 2j) is greater than the preset threshold, determining that the sub-pixel P(i, 2j+1) satisfies the preset determination condition; where G(i, 2j−1) is the initial gray level of the sub-pixel P(i, 2j−1), and G(i+1, 2j) is the initial gray level of the sub-pixel P(i+1, 2j), G(i, 2j+1) is the initial gray level of the sub-pixel P(i, 2j+1).

In an exemplary embodiment of the present disclosure, the optical compensation method for the display device further includes: inputting the initial gray level of each sub-pixel of a first preset picture to the driver; in the first preset picture, an absolute value of a difference between the initial gray levels of any two sub-pixels electrically connected to the same data line and located in two adjacent rows is greater than a preset threshold; acquiring an initial luminance of each sub-pixel in the display panel; determining the first compensation parameter of each sub-pixel based on the initial gray level of each sub-pixel and the initial luminance of each sub-pixel; and storing the first compensation parameter of each sub-pixel in the driver.

In an exemplary embodiment of the present disclosure, in the display panel, the sub-pixels in the same column are connected to the same data line.

In any same column of sub-pixels in the first preset picture, the absolute value of the difference between the initial gray levels of any two adjacent rows is greater than a preset threshold.

In an exemplary embodiment of the present disclosure, in the display panel, a sub-pixel P(i, 2j) and a sub-pixel P(i+1, 2j−1) are connected to a data line L(i+1), where the data line L(i+1) is the (i+1)th data line, the sub-pixel P(i, 2j) is a sub-pixel located in the i-th column and the 2j-th row, the sub-pixel P(i+1, 2j−1) is a sub-pixel located in the (i+1)th column and the (2j−1)th row, where i is a positive integer greater than 0 and j is a positive integer greater than 0.

In the first preset picture, the absolute value of the difference between G(i, 2j) and G(i+1, 2j−1) is greater than the preset threshold, and the absolute value of the difference between G(i, 2j) and G(i+1, 2j+1) is greater than the preset threshold; wherein G(i, 2j) is the initial gray level of the sub-pixel P(i, 2j), and G(i+1, 2j−1) is the initial gray level of the sub-pixel P(i+1, 2j−1), G(i+1, 2j+1) is the initial gray level of the sub-pixel P(i+1, 2j+1).

In an exemplary embodiment of the present disclosure, in the display panel, a sub-pixel P(i, 2j−1) and a sub-pixel P(i+1, 2j) are connected to the data line L(i+1), where the data line L(i+1) is the (i+1)th data line, the sub-pixel P(i, 2j−1) is a sub-pixel located in the i-th column and the (2j−1)th row, sub-pixel P(i+1, 2j) is a sub-pixel located in the (i+1)th column and the 2j-th row, where i is a positive integer greater than 0 and j is a positive integer greater than 0.

In the first preset picture, the absolute value of the difference between G(i, 2j−1) and G(i+1, 2j) is greater than the preset threshold, and the absolute value of the difference between G(i, 2j+1) and G(i+1, 2j) is greater than the preset threshold; wherein G(i, 2j−1) is the initial gray level of the sub-pixel P(i, 2j−1), and G(i+1, 2j) is the initial gray level of the sub-pixel P(i+1, 2j), G(i, 2j+1) is the initial gray level of the sub-pixel P(i, 2j+1).

In an exemplary embodiment of the present disclosure, the driver includes a timing controller; storing the first compensation parameter of each sub-pixel in the driver includes: storing the first compensation parameter of each sub-pixel in the timing controller.

In an exemplary embodiment of the present disclosure, the optical compensation method further includes, in response to determining that a sub-pixel does not satisfy the preset determination condition, acquiring a second compensation parameter of the sub-pixel, and compensating the initial gray level of the sub-pixel based on the acquired second compensation parameter.

In an exemplary embodiment of the present disclosure, the optical compensation method for the display device further includes: inputting the initial gray level of each sub-pixel of a second preset picture to the driver; in the second preset picture, an absolute value of a difference between the initial gray levels of any two sub-pixels electrically connected to the same data line and located in two adjacent rows does not exceed a preset threshold; acquiring an initial luminance of each sub-pixel in the display panel; determining the second compensation parameter of each sub-pixel based on the initial gray level of each sub-pixel and the initial luminance of each sub-pixel; and storing the second compensation parameter of each sub-pixel in the driver.

In an exemplary embodiment of the present disclosure, the first compensation parameter is a gray level difference value.

Compensating the initial gray level of the sub-pixel based on the acquired first compensation parameter includes: calculating a sum of the acquired first compensation parameter and the initial gray level of the sub-pixel to acquire a target gray level of the sub-pixel.

According to a second aspect of the present disclosure, there is provided a driver, and the driver is configured to drive a display panel, and the display panel includes sub-pixels arranged in an array; the driver includes: a data receiving circuit, configured to receive an initial gray level of each sub-pixel of a picture to be displayed; a determination circuit, electrically connected to the data receiving circuit, and configured to determine whether each sub-pixel satisfies a preset determination condition according to the initial gray level of each sub-pixel; if an absolute value of a difference between the initial gray levels of two sub-pixels electrically connected to a same data line and located in two adjacent rows is greater than a preset threshold, it is determined that the sub-pixel in a next row meets the preset determination condition; a first compensation parameter storage circuit, configured to store a first compensation parameter of each sub-pixel; and a first execution circuit, electrically connected to the determination circuit and the first compensation parameter storage circuit, and configured to, when it is determined that a sub-pixel satisfies the preset determination condition, acquire the first compensation parameter of the sub-pixel, and compensate the initial gray level of the sub-pixel based on the acquired first compensation parameter.

In an exemplary embodiment of the present disclosure, in the display panel, the sub-pixels in a same column are connected to a same data line; the determination circuit is configured to determine whether each sub-pixel satisfies a preset determination condition, and determining whether any sub-pixel in the next row meets the preset determination condition includes: calculating absolute values of differences between the initial gray levels of the sub-pixel in the next row and the sub-pixel in the previous row; if the absolute values of the differences are greater than a preset threshold, determining that the sub-pixel in the next row satisfies the preset determination condition.

In an exemplary embodiment of the present disclosure, in the display panel, a sub-pixel P(i, 2j) and a sub-pixel P(i+1, 2j−1) are connected to a data line L(i+1), where the data line L(i+1) is the (i+1)th data line, the sub-pixel P(i, 2j) is a sub-pixel located in the i-th column and the 2j-th row, the sub-pixel P(i+1, 2j−1) is a sub-pixel located in the (i+1)th column and the (2j−1)th row, where i is a positive integer greater than 0 and j is a positive integer greater than 0; the determination circuit is configured to: calculate an absolute value of a difference between G(i, 2j) and G(i+1, 2j−1), if the absolute value of the difference between G(i, 2j) and G(i+1, 2j−1) is greater than the preset threshold, determining that the sub-pixel P(i, 2j) satisfies the preset determination condition; calculate an absolute value of a difference between G(i+1, 2j+1) and G(i, 2j), if the absolute value of the difference between G(i+1, 2j+1) and G(i, 2j) is greater than the preset threshold, determining that the sub-pixel P(i+1, 2j+1) satisfies the preset determination condition; where, G(i, 2j) is the initial gray level of the sub-pixel P(i, 2j), and G(i+1, 2j−1) is the initial gray level of the sub-pixel P(i+1, 2j−1), G(i+1, 2j+1) is the initial gray level of the sub-pixel P(i+1, 2j+1).

In an exemplary embodiment of the present disclosure, in the display panel, a sub-pixel P(i, 2j−1) and a sub-pixel P(i+1, 2j) are connected to the data line L(i+1), where the data line L(i+1) is the (i+1)th data line, the sub-pixel P(i, 2j−1) is a sub-pixel located in the i-th column and the (2j−1)th row, sub-pixel P(i+1, 2j) is a sub-pixel located in the (i+1)th column and the 2j-th row, where i is a positive integer greater than 0 and j is a positive integer greater than 0; the determination circuit is configured to: calculate an absolute value of a difference between G(i+1, 2j) and G(i, 2j−1), if the absolute value of the difference between G(i+1, 2j) and G(i, 2j−1) is greater than the preset threshold, determining that the sub-pixel the sub-pixel P(i+1, 2j) satisfies the preset determination condition; calculate an absolute value of a difference between G(i, 2j+1) and G(i+1, 2j), if the absolute value of the difference between G(i, 2j+1) and G(i+1, 2j) is greater than the preset threshold, determining that the sub-pixel P(i, 2j+1) satisfies the preset determination condition; where G(i, 2j−1) is the initial gray level of the sub-pixel P(i, 2j−1), and G(i+1, 2j) is the initial gray level of the sub-pixel P(i+1, 2j), G(i, 2j+1) is the initial gray level of the sub-pixel P(i, 2j+1).

In an exemplary embodiment of the present disclosure, the driver further includes: a second compensation parameter storage circuit, configured to store a second compensation parameter of each sub-pixel; and a second execution circuit, electrically connected to the determination circuit and the second compensation parameter storage circuit, and configured to, when it is determined that a sub-pixel does not satisfy the preset determination condition, acquire the second compensation parameter of the sub-pixel, and compensate the initial gray level of the sub-pixel based on the acquired second compensation parameter.

According to a third aspect of the present disclosure, there is provided a display device including the above driver.

According to the driver, the display device and the optical compensation method of the present disclosure, when it is determined that the sub-pixel satisfies the preset determination condition based on the initial gray level of the sub-pixel, it can be known that the data voltage changes greatly when the sub-pixel is charged via the data line, and the sub-pixel is prone to insufficient charging. The sub-pixel is compensated by the first compensation parameter to make the sub-pixel display the correct brightness, and in turn, it is ensured that the sub-pixel is charged to the correct potential, thereby avoiding the problem of insufficient charging occurring when the sub-pixel satisfies the preset determination condition. As such, the optical compensation method of the present disclosure can directly compensate the initial gray level of the sub-pixel of the picture to be displayed, avoiding the problem of insufficient charging occurring when the sub-pixel satisfies the preset determination condition, and improving the compensation efficiency for the sub-pixel.

BRIEF DESCRIPTION OF THE DRAWINGS

The above and other features and advantages of the present disclosure will become more apparent by describing in detail example embodiments thereof with reference to the drawings.

Figure 1:
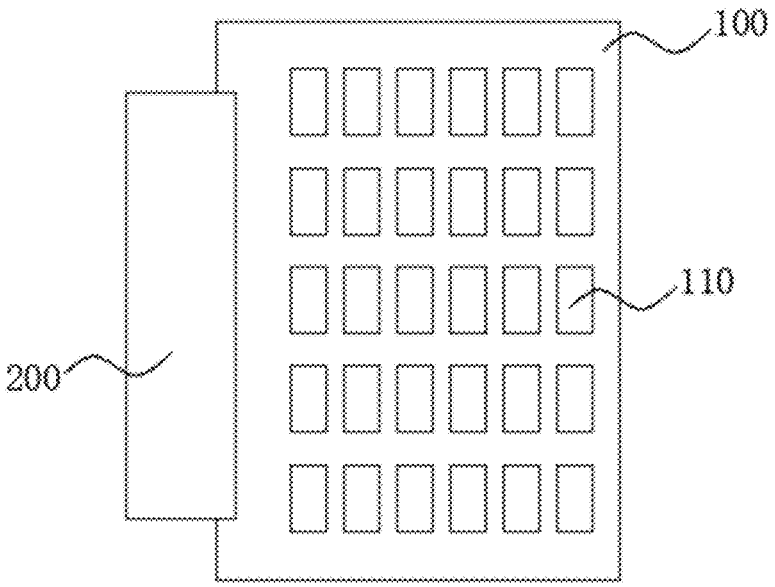
FIG. 1 is a schematic structural diagram of a display device of the present disclosure.

Reference numbers of main elements in the drawings are as follows:

100, display panel; 110, sub-pixel; 120, data line; 130, scan line; 200, driver; 201, timing controller; 210, data receiving circuit; 220, determination circuit; 230, first compensation parameter storage circuit 240, first execution circuit; 250, second compensation parameter storage circuit; 260, second execution circuit; 300, CCD camera; 400, computer.

DETAILED DESCRIPTION

Example embodiments will now be described more fully with reference to the accompanying drawings. However, the embodiments can be implemented in a variety of forms and should not be construed as being limited to the examples set forth herein; rather, these embodiments are provided so that this disclosure will be more complete so as to convey the idea of the exemplary embodiments to those skilled in this art. The described features, structures, or characteristics in one or more embodiments may be combined in any suitable manner. In the following description, many specific details are provided to give a full understanding of the embodiments of the present disclosure.

In the drawings, an area and a layer thickness may be exaggerated for clarity. The same reference numerals in the drawings denote the same or similar parts, and the repeated description thereof will be omitted. The terms "first" and "second" are only used as labels or markers, not to limit the number of objects.

Active driving technologies are widely used in the display field, which adopt a pixel driving circuit containing thin film transistors to control each sub-pixel to emit light independently. The pixel driving circuit may include one or more of an amorphous silicon thin film transistor (amorphous-Si TFT), a low temperature polysilicon thin film transistor (LTPS TFT), and an oxide thin film transistor (Oxide TFT). However, the thin-film transistors have uniformity or stability problems, resulting in differences in threshold voltages of thin-film transistors at different positions of the display panel, which leads to differences in brightness of the display panel at different positions. In the related art, a compensation method can be used to eliminate or reduce the brightness difference of the display panel. For example, demura compensation can be used to make the dark area brighter, make the bright area darker, or eliminate the resulted color shift, and finally make different areas on the display panel have substantially the same brightness or color.

As a refresh rate and a size of the display panel continue to increase, a charging time for each sub-pixel becomes shorter and shorter. For example, in a 120 Hz display panel, the charging time for a single data line is reduced from 3.75 microseconds at 60 Hz to 1.85 microseconds, and a fall time $T_f$ of the gate signal is generally designed to be around 1 microsecond. Therefore, when a heavy-loaded picture appears, the amount of charges in a storage capacitor of a pixel driving circuit changes greatly due to a great change in the pixel gray level between adjacent pixels on the same data line, and the problem of insufficient charging is likely to occur, as a result, the storage capacitor cannot accurately reach an expected voltage.

Although the demura compensation can be performed on the display panel in the related art, a light-loaded picture where a change in the pixel gray levels between adjacent pixels on the same data line is small is usually selected when the demura compensation is performed in the related art. Further, in the related art, muras with high, medium, and low gray levels are usually detected, and then an average demura data of the high, medium, and low gray level is acquired. Therefore, even if the demura compensation can be performed on the display panel according to the related art, when the display panel is loaded with a heavy-loaded picture, the problem of insufficient charging is still likely to occur, causing the storage capacitor to fail to accurately reach the expected voltage.

Figure 2:
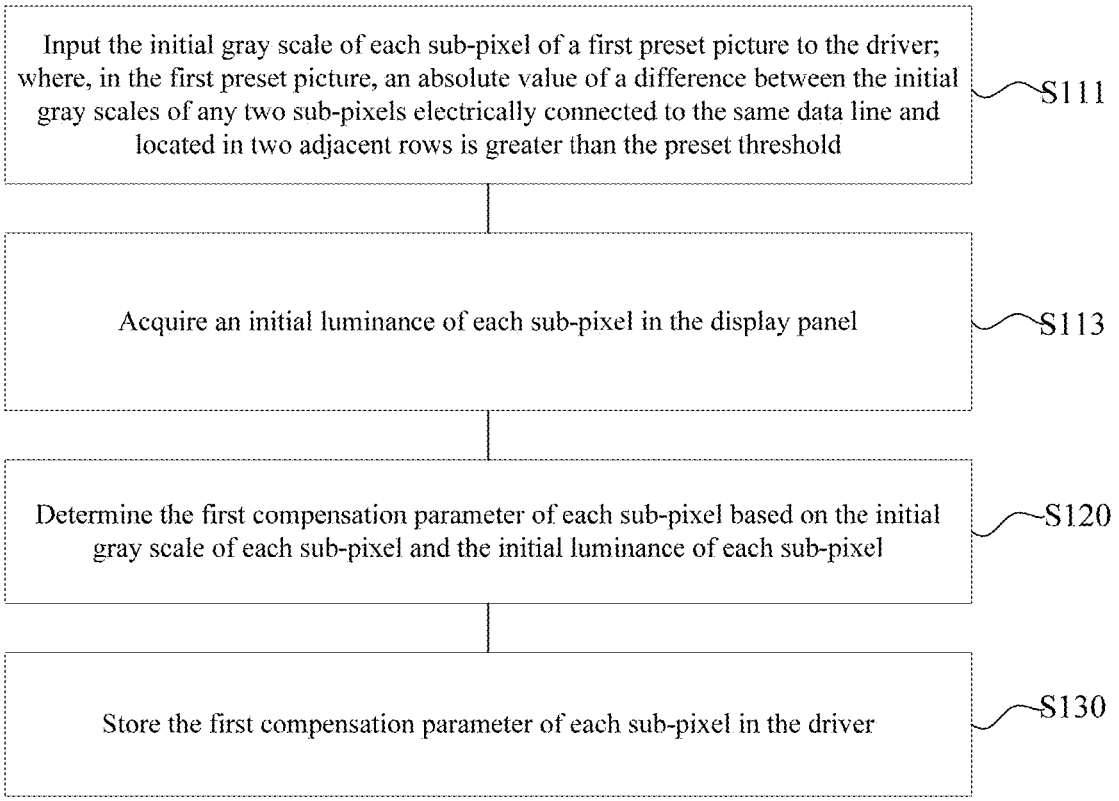
FIG. 2 is a schematic flowchart of an optical compensation calibration method for a display device of the present disclosure.

An embodiment of the present disclosure provides an optical compensation calibration method for a display device. As shown in FIG. 1, the display device includes a driver 200 and a display panel 100, and the display panel 100 includes a plurality of sub-pixels 110 arranged in an array. As shown in FIG. 2, the optical compensation calibration method for the display device includes steps described below.

In step S111, an initial gray level of each sub-pixel 110 of a first preset picture is input to the driver 200. In the first preset picture, an absolute value of a difference between the initial gray levels of any two sub-pixels electrically connected to the same data line and located in two adjacent rows is greater than a preset threshold.

In step S113, an initial luminance of each sub-pixel 110 in the display panel 100 is acquired.

In step S120, a first compensation parameter of each sub-pixel 110 is determined according to the initial gray level of each sub-pixel 110 and the initial luminance of each sub-pixel 110.

In step S130, the first compensation parameter of each sub-pixel 110 is stored in the driver 200.

According to the optical compensation calibration method provided by the present disclosure, the optical compensation calibration can be performed on the basis of the first preset picture during the optical compensation calibration stage, so that each sub-pixel 110 can accurately emit light when the first preset picture is displayed, thereby acquiring the first compensation parameter of each sub-pixel 110 of the display panel 100 in the first preset image. Since each sub-pixel 110 compensated by the first compensation parameter can accurately emit light when the first preset picture is displayed, it is ensured that each sub-pixel 110 can be accurately charged to the expected voltage when the first preset picture is displayed, eliminating the problem of insufficient charging rate of each sub-pixel 110 when the first preset picture is displayed.

The steps of the optical compensation calibration method of the display device provided by the embodiments of the present disclosure will be described in detail below with reference to the drawings.

In step S111, display data of the first preset picture may be input to a data interface circuit of the driver 200, and the driver 200 may acquire the initial gray level of each sub-pixel 110 of the first preset picture according to the received display data of the first preset picture.

Figure 18:
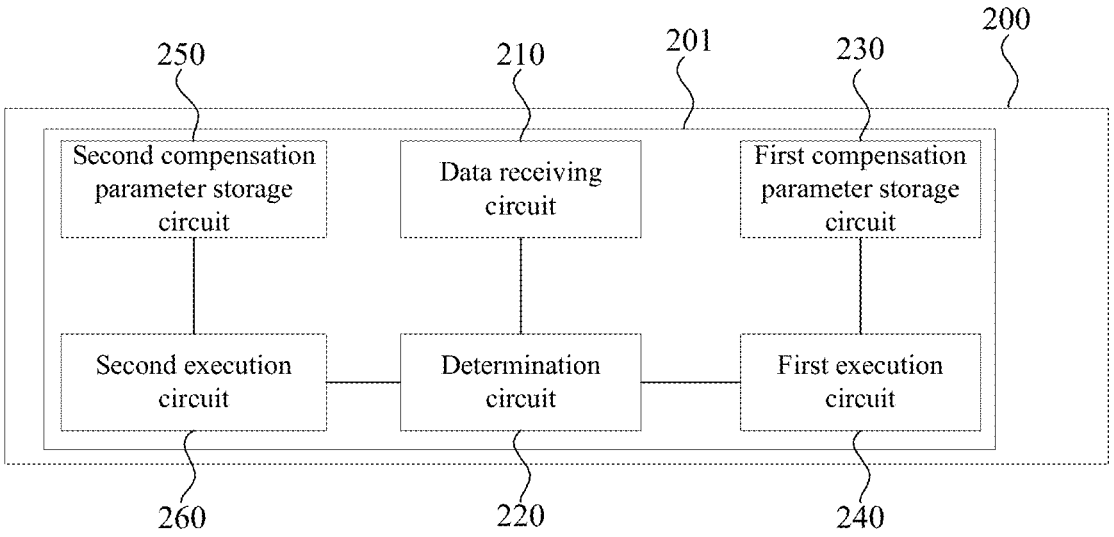
FIG. 18 is a schematic structural diagram of a driver of the present disclosure.

For example, in an embodiment of the present disclosure, as shown in FIG. 18, the driver 200 includes a timing controller 201 (TCON), and the timing controller 201 is provided with the data interface circuit and a picture detection (PD) circuit. The data interface circuit is configured to exchange data with the external of the display device, especially to receive the display data of the image to be displayed input to the display device from the external. The picture detection circuit is electrically connected to the data interface circuit, and is configured to acquire the initial gray level of each sub-pixel 110 of the image to be displayed according to the display data. The data interface circuit and the picture detection circuit constitute a data receiving circuit 210 of the driver 200, so that the driver 200 can acquire the initial gray level of each sub-pixel 110 of the image to be displayed.

The initial gray level of the sub-pixel 110 refers to a gray level of the sub-pixel 110 that is externally input and uncompensated.

In step S113, the driver 200 drives the display panel 100 to display a picture based on the initial gray level of each sub-pixel 110 of the first preset picture. At this time, each sub-pixel 110 emits light independently and has luminance independently, and collects the luminance of each sub-pixel 110 to acquire the initial luminance of each sub-pixel 110.

Figure 3:
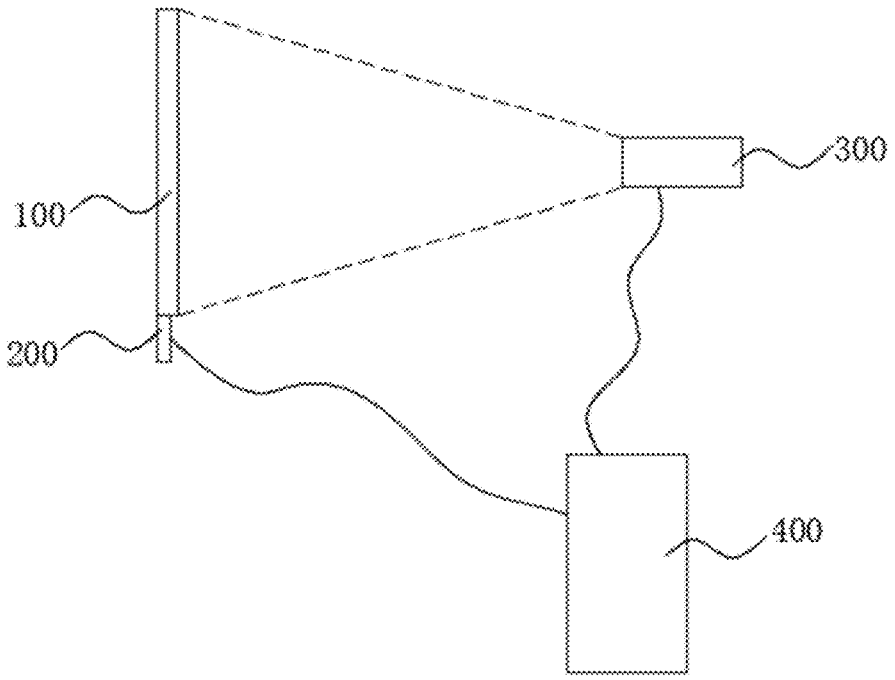
FIG. 3 is a schematic structural diagram of an optical compensation calibration device for a display device of the present disclosure.

Optionally, in an embodiment of the present disclosure, as shown in FIG. 3, the initial luminance of each sub-pixel 110 may be acquired by an optical extraction method. For example, the driver 200 can light up the display panel 100 according to the initial gray level of each sub-pixel 110 of the first preset picture, a CCD (charge coupled device) camera is used to collect the screen displayed by the display panel 100, and a computer 400 connected to the CCD camera 300 receives the screen collected by the CCD camera 300 and analyzes the luminance of each sub-pixel 110.

Optionally, in step S120, the computer 400 may acquire the first compensation parameter of each sub-pixel 110 based on the initial gray level and the luminance of each sub-pixel 110. In step S130, the computer 400 may write the first compensation parameter of each sub-pixel 110 into the driver 200.

Figure 4:
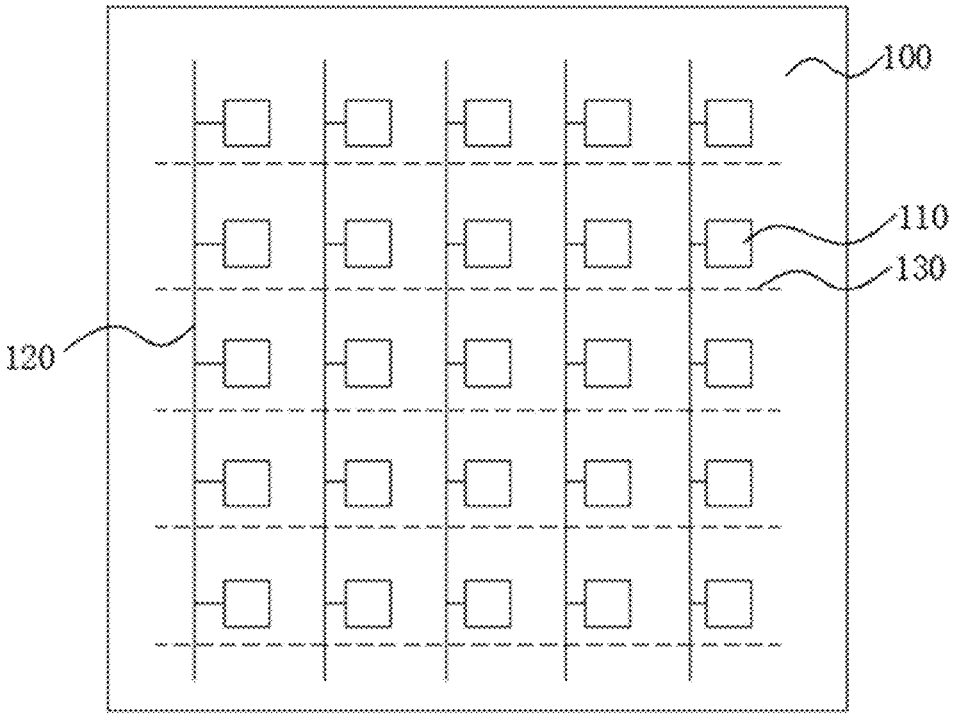
FIG. 4 is a schematic structural diagram of a display panel of the present disclosure.
Figure 5:
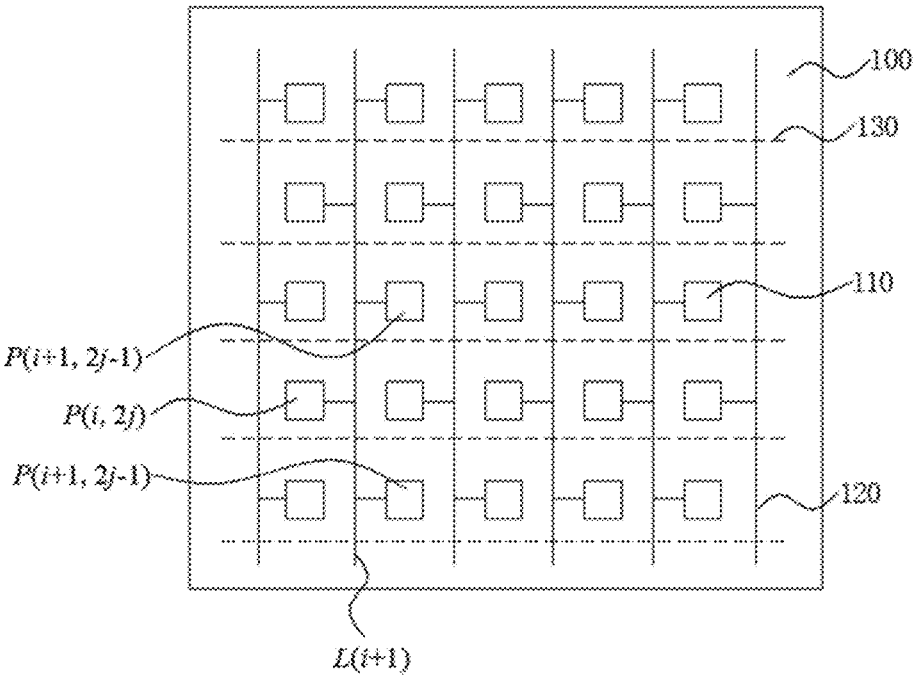
FIG. 5 is a schematic structural diagram of a display panel of the present disclosure.
Figure 6:
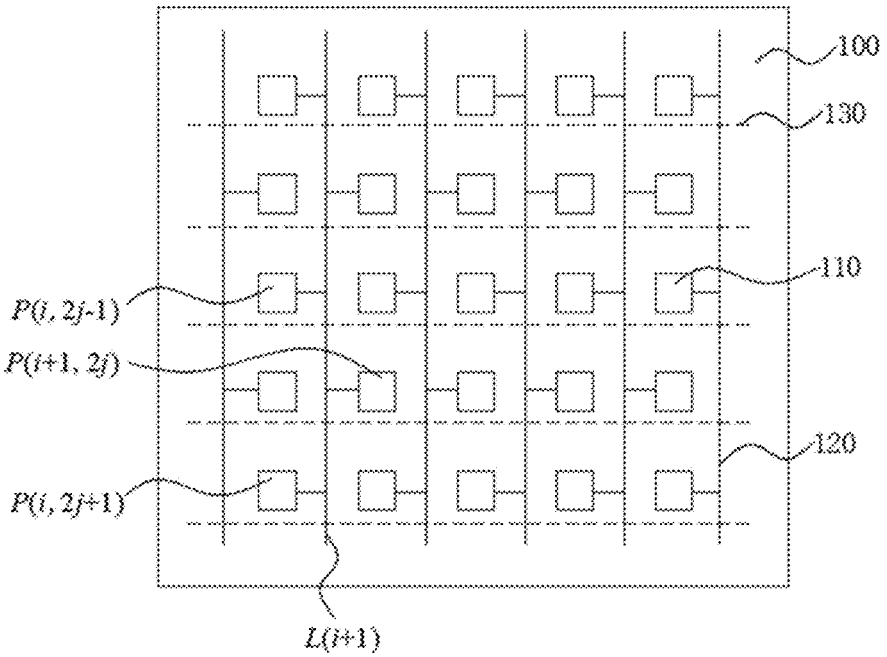
FIG. 6 is a schematic structural diagram of a display panel of the present disclosure.
Figure 7:
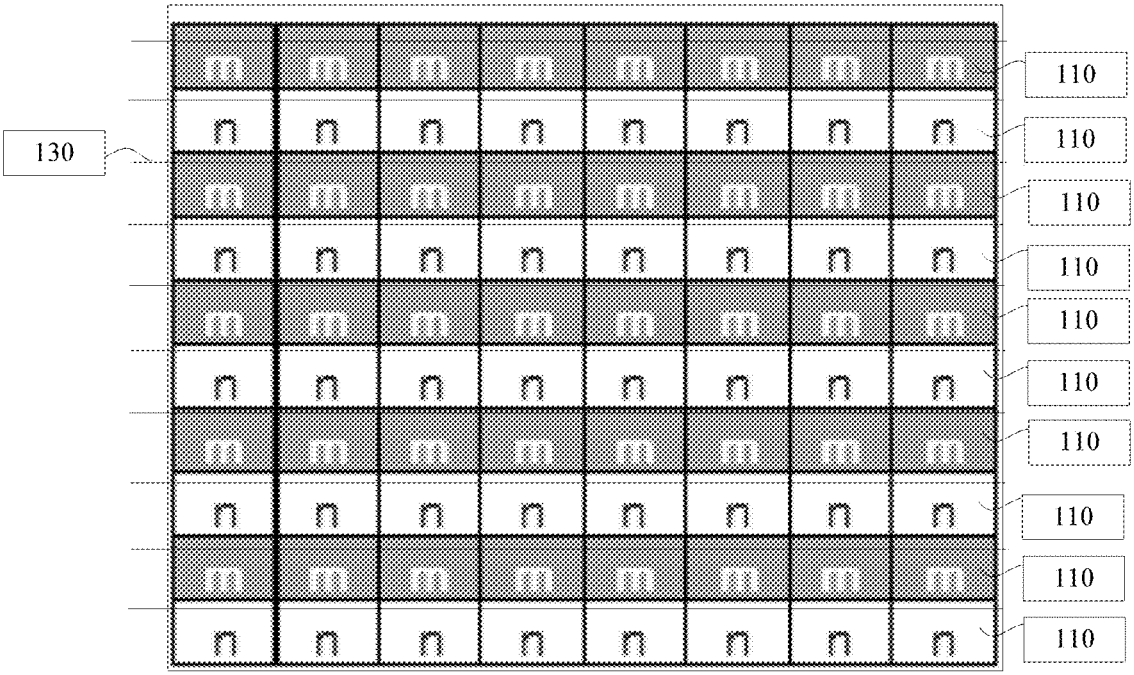
FIG. 7 is a schematic structural diagram of a first preset picture of the present disclosure.
Figure 8:
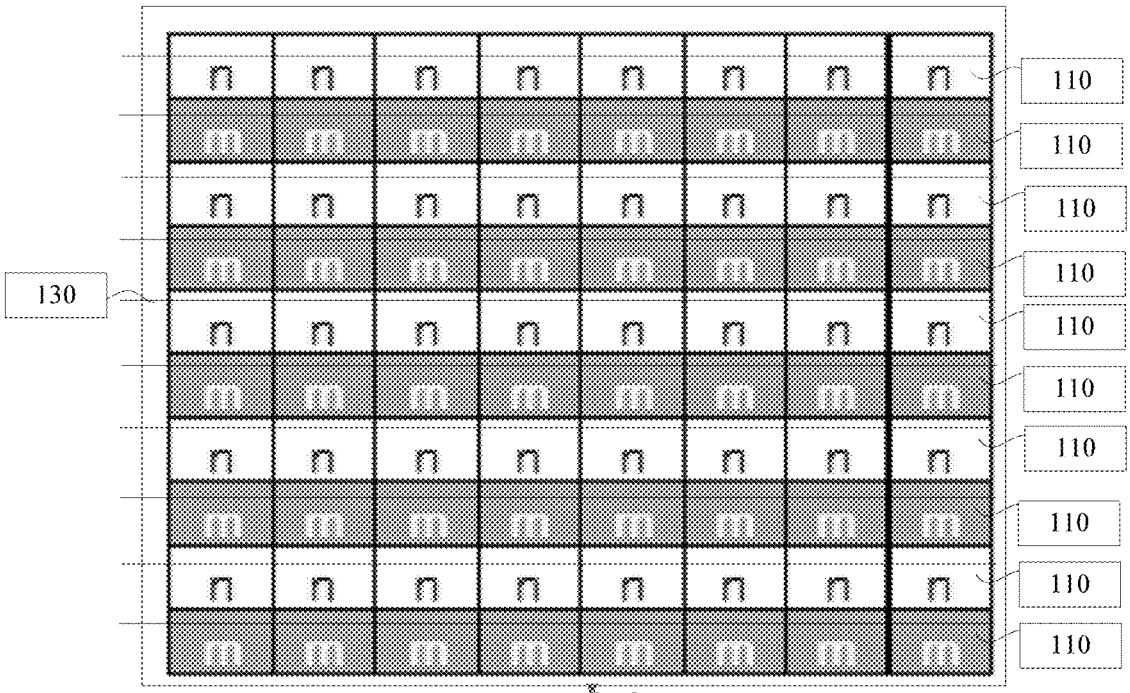
FIG. 8 is a schematic structural diagram of a first preset picture of the present disclosure.
Figure 9:
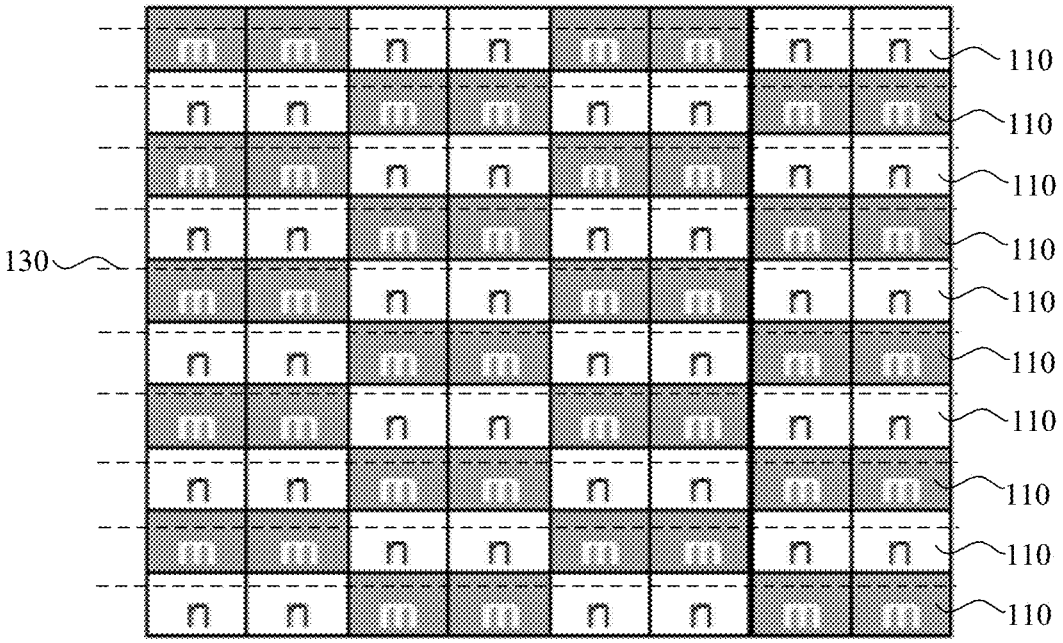
FIG. 9 is a schematic structural diagram of a first preset picture of the present disclosure.
Figure 10:
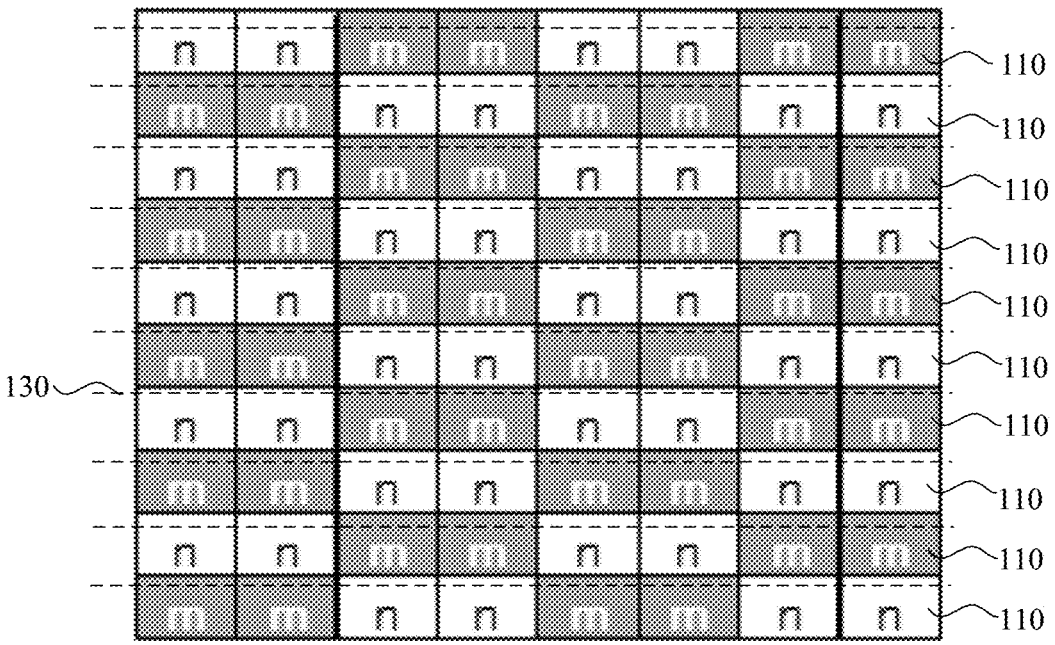
FIG. 10 is a schematic structural diagram of a first preset picture of the present disclosure.
Figure 11:
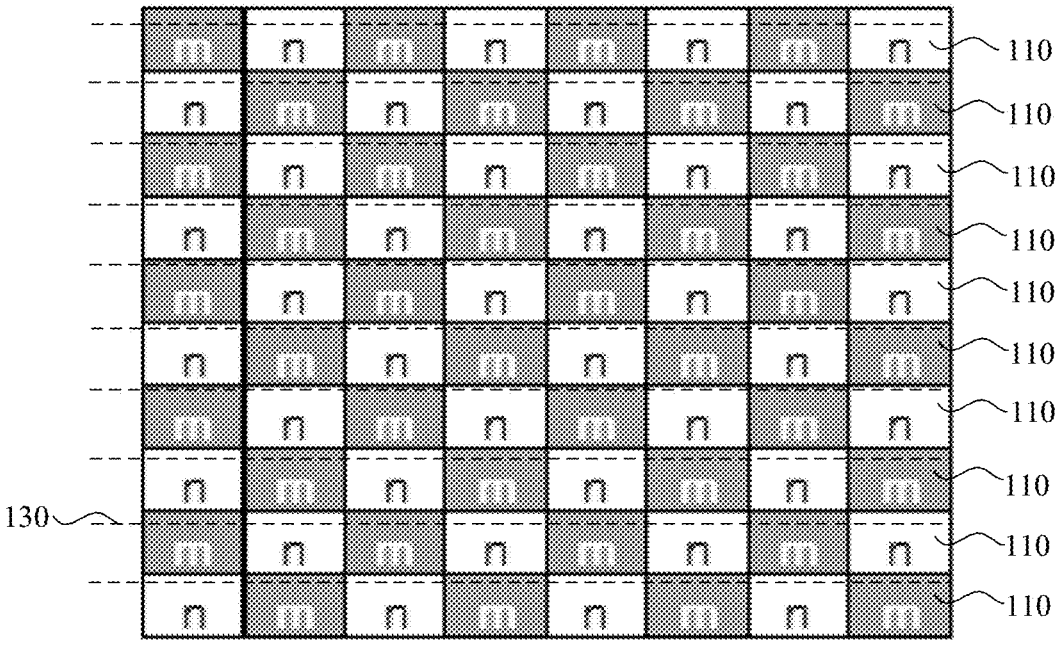
FIG. 11 is a schematic structural diagram of a first preset picture of the present disclosure.
Figure 12:
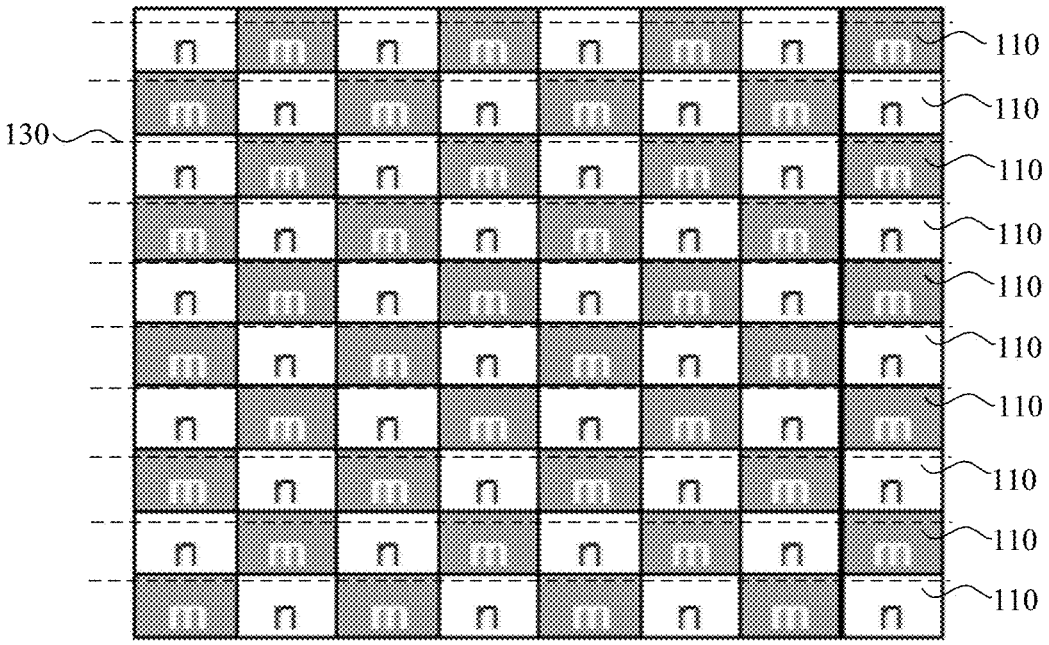
FIG. 12 is a schematic structural diagram of a first preset picture of the present disclosure.

In step S111, the first preset picture is a first type of picture. The characteristic of the first type of picture is that, as shown in FIG. 4 to FIG. 6, when the data line 120 is used to charge sub-pixels 110 in two adjacent rows, the amplitude of the data voltage changes greatly, which may easily lead to insufficient charging of the sub-pixel 110 in the next row. In the first type of picture, for any two sub-pixels 110 electrically connected to the same data line 120 and located in two adjacent rows, the absolute value of the difference between the initial gray levels of the two sub-pixels 110 exceeds a preset threshold. It can be understood that, for two sub-pixels 110 electrically connected to the same data line 120 and located in two adjacent rows, the two sub-pixels 110 may be located on the same side of the data line 120 or on both sides of the data line 120. It can be understood that when the sub-pixels 110 on the display panel 100 are arranged in different ways, the same picture may be the first type of picture on one type of display panel 100, but not the first type of picture on another type of display panel 100.

Contrary to the first type of picture, a second type of picture is characterized in that, as shown in FIG. 4 to FIG. 6, when the data line 120 is used to charge sub-pixels 110 in two adjacent rows, the amplitude of the data voltage changes little, and it is not easy to cause the insufficient charging of the sub-pixel 110 in the next row. In the second type of picture, for any two sub-pixels 110 electrically connected to the same data line 120 and located in two adjacent rows, the absolute value of the difference between the initial gray levels of the two sub-pixels 110 does not exceed a preset threshold. It can be understood that, for two sub-pixels 110 electrically connected to the same data line 120 and located in two adjacent rows, the two sub-pixels 110 may be located on the same side of the data line 120 or on both sides of the data line 120. It can be understood that when the sub-pixels 110 on the display panel 100 are arranged in different ways, the same picture may be the second type of picture on one type of display panel 100, but not the second type of picture on another type of display panel 100.

Similarly, in the present disclosure, for two sub-pixels 110 electrically connected to the same data line 120 and located in two adjacent rows, if the absolute value of the difference between the initial gray levels of the two sub-pixels 110 exceeds a preset threshold, it can be considered that the sub-pixel 110 in the next row satisfies the preset determination condition, that is to say, when the data line 120 charges the sub-pixel 110 in the next row, the amplitude of the data voltage changes greatly, and it may easily lead to insufficient charging of the sub-pixel 110 in the next row. It can be understood that the sub-pixel 110 in the next row is the sub-pixel 110 that is charged later in the charging sequence.

The preset threshold can be selected and determined according to different optical compensation calibration requirements. Optionally, the preset threshold may be ⅕~⅓ of the maximum gray level number of the sub-pixel 110. For example, if the gray level of the sub-pixel 110 is in a range of 0~255, the maximum gray level number is 256, and the preset threshold may be selected from 51~85.

Further, the preset threshold may be ¼ of the maximum gray level number of the sub-pixel 110; thus, for the 8-bit gray level sub-pixel 110 (the maximum gray level number is 256), the preset threshold is 64.

In the present disclosure, when the term "row" is used for description, it refers to an extending direction of the data line 120. When the term "column" is used for description, it refers to an extending direction of the scan line 130. "Row" and "Column" are relative concepts defined according to the data line 120 and the scan line 130, and this definition is a common way in the art; in the art, the concepts of "row" and "column" are different from the concepts of "horizontal" and "vertical".

In the following, several different types of display panels, and the determination criteria of the first type of picture and the second type of picture corresponding to each type of display panel are exemplified to further explain and illustrate the first type of picture and the second type of picture.

In an embodiment of the present disclosure, as shown in FIG. 4, in the display panel 100, the same column of sub-pixels 110 is connected to the same data line 120, and one data line 120 is connected to one column of sub-pixels 110.

In this type of display panel 100, in sub-pixels 110 of any column of the first type of picture, the absolute value of the difference between the initial gray levels of the sub-pixels 110 in any two adjacent rows is greater than a preset threshold. Therefore, in step S111, in sub-pixels 110 of any same column of the first type of picture, the absolute value of the difference between the initial gray levels of the sub-pixels 110 in any two adjacent rows is greater than a preset threshold.

In this type of display panel 100, in sub-pixels 110 of any column of the second type of picture, the absolute value of the difference between the initial gray levels of sub-pixels 110 in any two adjacent rows is not greater than a preset threshold.

In another embodiment of the present disclosure, as shown in FIG. 5, in the display panel 100, among sub-pixels 110 in two adjacent columns, the sub-pixels 110 in odd-numbered rows and in one column of the two adjacent columns as well as the sub-pixels 110 in even-numbered rows and in another column of the two adjacent columns are connected to the same data line 120. The sub-pixel 110 P(i, 2j) and the sub-pixel 110 P(i+1, 2j−1) are connected to the data line 120 L(i+1), the data line 120 L(i+1) is a (i+1)th data line 120, the sub-pixel 110 P(i, 2j) is a sub-pixel 110 located in a i-th column and a 2j-th row, and the sub-pixel 110 P(i+1, 2j−1) is a sub-pixel 110 located in a (i+1)th column and a (2j−1)th row, where i is a positive integer greater than 0 and j is a positive integer greater than 0. It can be understood that i+1 is not greater than the total number of data lines 120; neither 2j nor 2j−1 is greater than the total number of rows of sub-pixels 110.

In this type of display panel 100, in the first type of picture, the absolute value of the difference between G(i, 2j) and G(i+1, 2j−1) is greater than the preset threshold, and the absolute value of the difference between G(i, 2j) and G(i+1, 2j+1) is greater than the preset threshold, where G(i, 2j) is the initial gray level of the sub-pixel 110 P(i, 2j), G(i+1, 2j−1) is the initial gray level of the sub-pixel 110 P(i+1, 2j−1), G(i+1, 2j+1) is the initial gray level of the sub-pixel 110 P(i+1, 2j+1).

Therefore, in step S111, in the first preset picture, the absolute value of the difference between G(i, 2j) and G(i+1, 2j−1) is greater than the preset threshold, and the absolute value of the difference between G(i, 2j) and G(i+1, 2j+1) is greater than the preset threshold, where G(i, 2j) is the initial gray level of the sub-pixel 110 P(i, 2j), G(i+1, 2j−1) is the initial gray level of the sub-pixel 110 P(i+1, 2j−1), G(i+1, 2j+1) is the initial gray level of the sub-pixel 110 P(i+1, 2j+1).

In this type of display panel 100, in the second type of picture, the absolute value of the difference between G(i, 2j) and G(i+1, 2j−1) is not greater than the preset threshold, and the absolute value of the difference between G(i, 2j) and G(i+1, 2j+1) is not greater than the preset threshold, where G(i, 2j) is the initial gray level of the sub-pixel 110 P(i, 2j), G(i+1, 2j−1) is the initial gray level of the sub-pixel 110 P(i+1, 2j−1), G(i+1, 2j+1) is the initial gray level of the sub-pixel 110 P(i+1, 2j+1).

In another embodiment of the present disclosure, as shown in FIG. 6, in the display panel 100, among sub-pixels 110 in two adjacent columns, the sub-pixels 110 in odd-numbered rows and in one column of the two adjacent columns as well as the sub-pixels 110 in even-numbered rows and in another column of the two adjacent columns are connected to the same data line 120. The sub-pixel 110 P(i, 2j−1) and the sub-pixel 110 P(i+1, 2j) are connected to the data line 120 L(i+1), the data line 120 L(i+1) is a (i+1)th data line 120, the sub-pixel 110 P(i, 2j−1) is a sub-pixel 110 located in a i-th column and a (2j−1)th row, and the sub-pixel 110 P(i+1, 2j) is a sub-pixel 110 located in a (i+1)th column and a 2j-th row, where i is a positive integer greater than 0 and j is a positive integer greater than 0. It can be understood that i+1 is not greater than the total number of data lines 120; neither 2j nor 2j−1 is greater than the total number of rows of sub-pixels 110.

In this type of display panel 100, in the first type of picture, the absolute value of the difference between G(i, 2j−1) and G(i+1, 2j) is greater than the preset threshold, and the absolute value of the difference between G(i, 2j+1) and G(i+1, 2j) is greater than the preset threshold, where G(i, 2j−1) is the initial gray level of the sub-pixel 110 P(i, 2j−1), G(i+1, 2j) is the initial gray level of the sub-pixel 110 P(i+1, 2j), G(i, 2j+1) is the initial gray level of the sub-pixel 110 P(i, 2j+1).

Therefore, in step S111, in the first preset picture, the absolute value of the difference between G(i, 2j−1) and G(i+1, 2j) is greater than the preset threshold, and the absolute value of the difference between G(i, 2j+1) and G(i+1, 2j) is greater than the preset threshold, where G(i, 2j−1) is the initial gray level of the sub-pixel 110 P(i, 2j−1), G(i+1, 2j) is the initial gray level of the sub-pixel 110 P(i+1, 2j), G(i, 2j+1) is the initial gray level of the sub-pixel 110 P(i, 2j+1).

In this type of display panel 100, in the second type of picture, the absolute value of the difference between G(i, 2j−1) and G(i+1, 2j) is not greater than the preset threshold, and the absolute value of the difference between G(i, 2j+1) and G(i+1, 2j) is not greater than the preset threshold, where G(i, 2j−1) is the initial gray level of the sub-pixel 110 P(i, 2j−1), G(i+1, 2j) is the initial gray level of the sub-pixel 110 P(i+1, 2j), G(i, 2j+1) is the initial gray level of the sub-pixel 110 P(i, 2j+1).

In an embodiment of the present disclosure, in step S111, the number of the first preset pictures may be multiple; correspondingly, the initial gray level of each sub-pixel 110 corresponding to each first preset picture may be acquired, and the initial luminance of each sub-pixel 110 corresponding to each first preset image may be acquired.

For example, as shown in FIG. 4, in the display panel 100, when sub-pixels 110 in the same column are connected to the same data line 120 and one data line 120 is connected to one column of sub-pixels 110, multiple first preset pictures may include the pictures shown in FIG. 7 to FIG. 12. In the pictures shown in FIG. 7 to FIG. 12, as for two sub-pixels 110 adjacent to each other in the upper and lower rows, the initial gray level of one sub-pixel 110 is m, and the initial gray level of the other sub-pixel 110 is n, and the absolute value of the difference between m and n is greater than the preset threshold. Further, the value of n may be 0.

Figure 13:
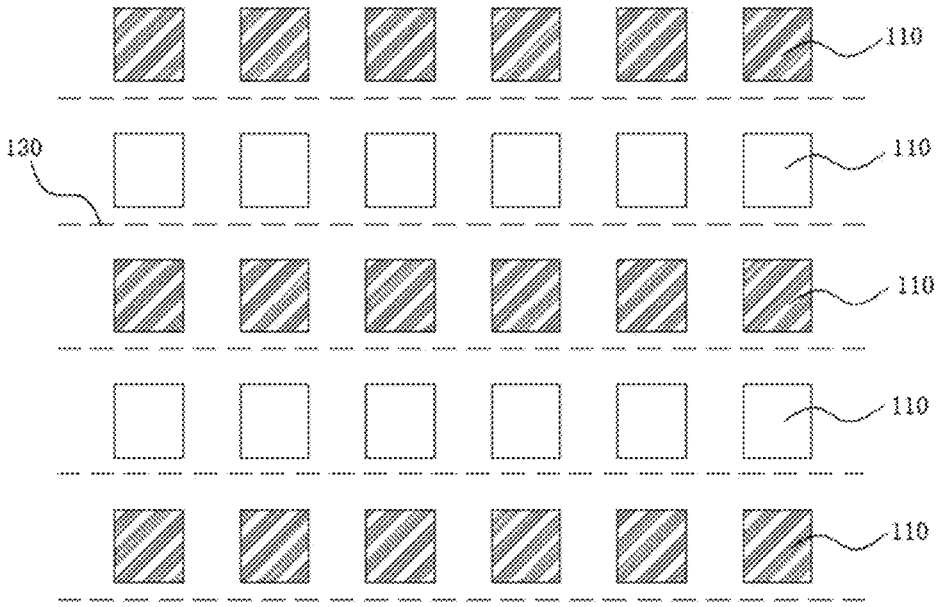
FIG. 13 is a schematic structural diagram of a first preset picture of the present disclosure.
Figure 14:
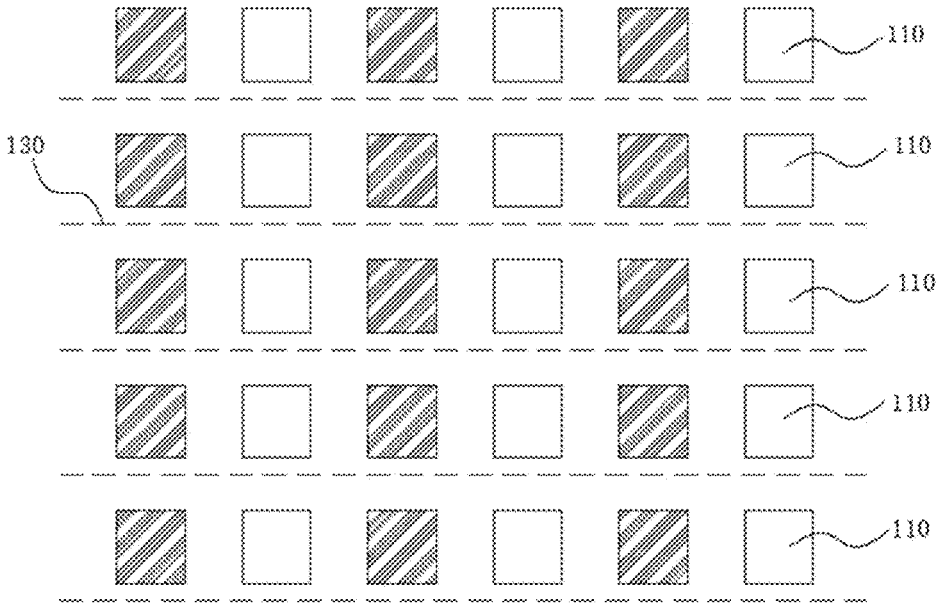
FIG. 14 is a schematic structural diagram of a first preset picture of the present disclosure.
Figure 15:
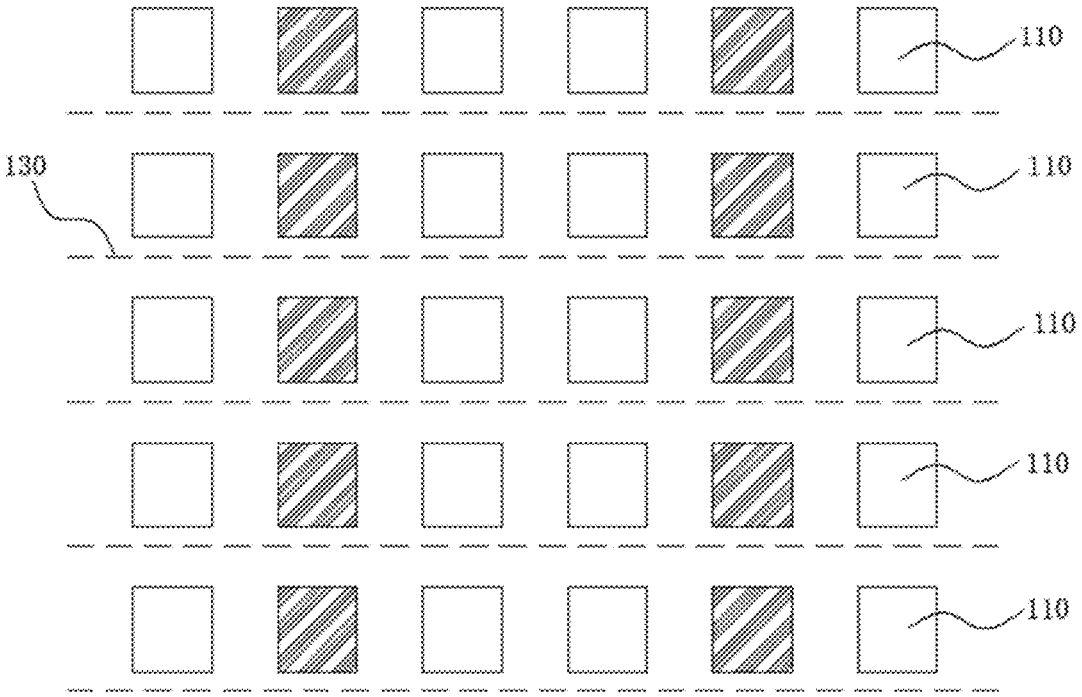
FIG. 15 is a schematic structural diagram of a first preset picture of the present disclosure.

As another example, as shown in FIGS. 5 and 6, in the display panel 100, among sub-pixels 110 in the two adjacent columns, the sub-pixels 110 in odd-numbered rows and in one column of the two adjacent columns as well as the sub-pixels 110 in even-numbered rows and in another column of the two adjacent columns are connected to the same data line 120, the plurality of first preset pictures may include the pictures shown in FIGS. 13-15. FIG. 14 may be a flicker picture, and in any two adjacent columns of sub-pixels 110, one column of sub-pixels 110 emits light and the other column of sub-pixels 110 does not emit light. FIG. 13 may be a H1 line picture, where in any two adjacent rows of sub-pixels 110, one row of sub-pixels 110 emits light and the other row of sub-pixels 110 does not emit light. In FIG. 15, between two adjacent columns of sub-pixels 110 that emit light, there are two columns of sub-pixels 110 that do not emit light. As such, if any row of sub-pixels 110 includes periodically arranged sub-pixels 110 of three colors of red, green, and blue, and the same column of sub-pixels 110 is the same color of sub-pixels 110, then the graph CCC is one of the three solid colors of red, green, and blue.

In step S120, each sub-pixel 110 may be compensated by the demura algorithm to acquire the first compensation parameter of each sub-pixel 110. The first compensation parameter may have a plurality of different forms. For example, in an embodiment of the present disclosure, the first compensation parameter may be a compensation coefficient, and the product of the compensation coefficient and the initial gray level of the sub-pixel 110 is used as a target gray level of the sub-pixel 110. As another example, in another embodiment of the present disclosure, the first compensation parameter may be a gray level difference value, where the gray level difference value may be a positive value, a negative value, or 0. The sum of the initial gray level of the sub-pixel 110 and the gray level difference value serves as the target gray level of the sub-pixel 110. As another example, in another embodiment of the present disclosure, the first compensation parameter includes two parameters; one parameter is used to compensate the initial gray level of the sub-pixel 110 in the next row, when the initial gray level of the sub-pixel 110 in the next row is greater than the initial gray level of the sub-pixel 110 in the previous row; the other parameter is used to compensate the initial gray level of the sub-pixel 110 in the next row, when the initial gray level of the sub-pixel 110 in the next row is less than the initial gray level of the sub-pixel 110 in the previous row.

In step S130, the first compensation parameter of each sub-pixel 110 may be stored in the timing controller 201 of the driver 200.

Optionally, in an embodiment of the present disclosure, the first compensation parameter of each sub-pixel 110 may form a first compensation table, and the first compensation table records the one-to-one correspondence of each sub-pixel 110 and the first compensation parameter of each sub-pixel 110. The first compensation table may be stored in the driver 200, for example, burned into the timing controller 201 of the driver 200.

Optionally, the driver 200 may include a first compensation parameter storage circuit 230 for storing the first compensation parameter of each sub-pixel 110.

Figure 16:
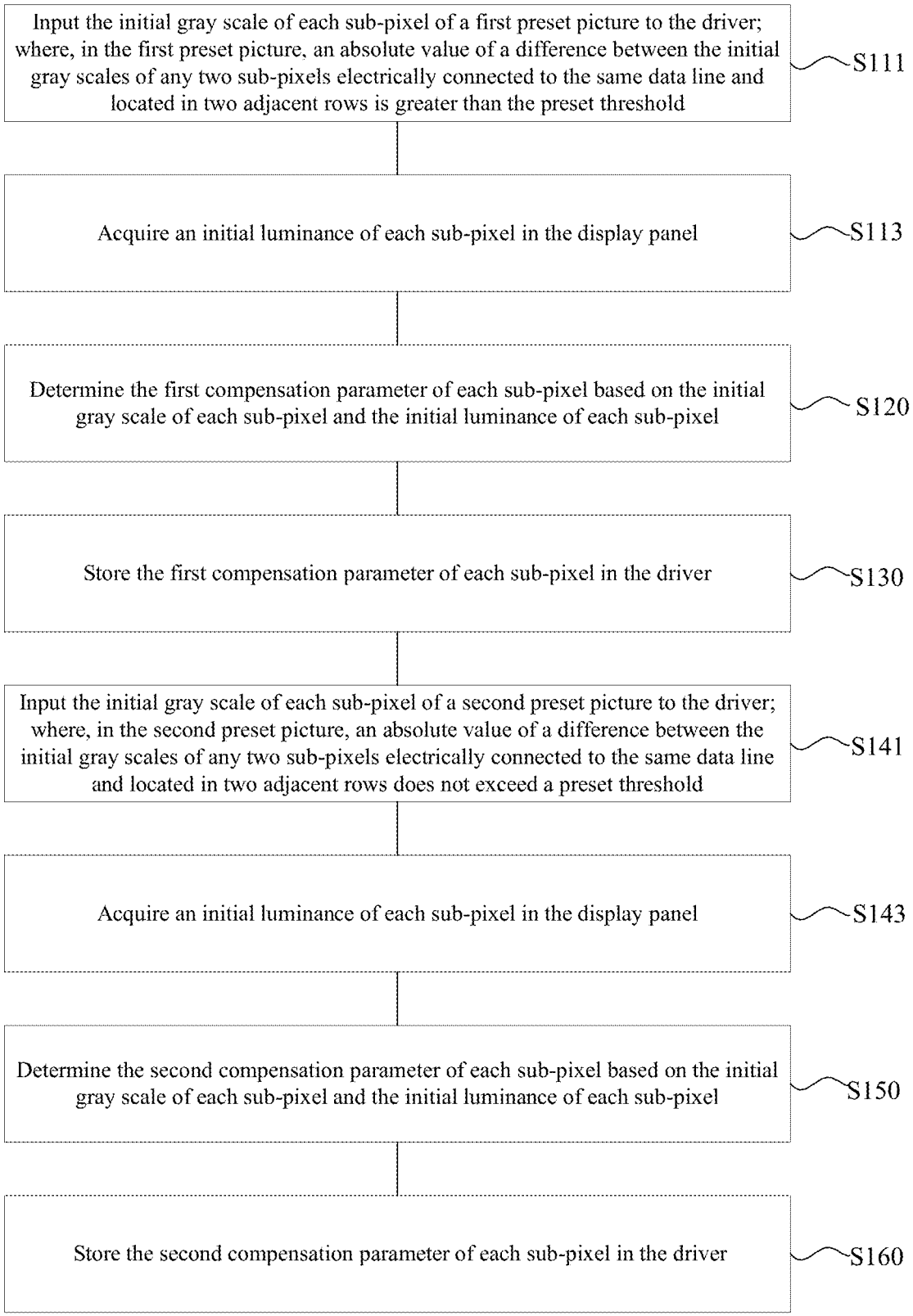
FIG. 16 is a schematic flowchart of an optical compensation calibration method for a display device of the present disclosure.

As shown in FIG. 16, the optical compensation calibration method of the present disclosure may further include the following steps.

In step S141, an initial gray level of each sub-pixel 110 of a second preset picture is input to the driver 200. The second preset picture is a second type of picture.

In step S143, an initial luminance of each sub-pixel 110 in the display panel 100 is acquired.

In step S150, a second compensation parameter of each sub-pixel 110 is determined based on the initial gray level of each sub-pixel 110 and the initial luminance of each sub-pixel 110.

In step S160, the second compensation parameter of each sub-pixel 110 is stored in the driver 200.

As such, the optical compensation calibration method of the present disclosure can also complete the demura calibration through the second type of picture to acquire the second compensation parameter of each sub-pixel 110. Thus, when the sub-pixel 110 of the picture to be displayed does not satisfy the preset determination condition, the initial gray level of the sub-pixel 110 can be compensated by the second compensation parameter, so that the sub-pixel 110 can be accurately charged and emit light.

In an embodiment of the present disclosure, the second compensation parameters of each sub-pixel 110 may form a second compensation table, and the second compensation table records the one-to-one correspondence of each sub-pixel 110 and the second compensation parameter of each sub-pixel 110. In step S160, the second compensation table may be stored in the driver 200, for example, burned into the timing controller 201 of the driver 200.

In step S150, each sub-pixel 110 may be compensated by the demura algorithm to acquire the second compensation parameter of each sub-pixel 110. The second compensation parameter may have a plurality of different forms. For example, in an embodiment of the present disclosure, the second compensation parameter may be a compensation coefficient, and the product of the compensation coefficient and the initial gray level of the sub-pixel 110 is used as the target gray level of the sub-pixel 110. As another example, in another embodiment of the present disclosure, the second compensation parameter may be a gray level difference value, where the gray level difference value may be a positive value, a negative value, or 0. The sum of the initial gray level of the sub-pixel 110 and the gray level difference value serves as the target gray level of the sub-pixel 110. As another example, in another embodiment of the present disclosure, the second compensation parameter includes two parameters; one parameter is used to compensate the initial gray level of the sub-pixel 110 in the next row, when the initial gray level of the sub-pixel 110 in the next row is greater than the initial gray level of the sub-pixel 110 in the previous row; the other is used to compensate the initial gray level of the sub-pixel 110 in the next row, when the initial gray level of the sub-pixel 110 in the next row is less than the initial gray level of the sub-pixel 110 in the previous row.

In another embodiment of the present disclosure, as shown in FIG. 18, the timing controller 201 of the driver 200 may further include a second compensation parameter storage circuit 250 for storing the second compensation parameter of each sub-pixel 110.

Optionally, the step S130 and step S160 are performed simultaneously, that is, after the first compensation parameter and the second compensation parameter of each sub-pixel 110 are acquired, the first compensation parameter and the second compensation parameter of each sub-pixel 110 are stored in the driver 200.

The optical compensation calibration method of the present disclosure may further include the following steps.

In step S171, an initial gray level of each sub-pixel 110 of a first preset picture is input to the driver 200. The driver 200 compensates the initial gray level of each sub-pixel 110 of the first preset picture based on the first compensation parameter of each sub-pixel 110 to acquire the target gray level of each sub-pixel 110. The driver 200 lights up the display panel 100 based on the target gray level of each sub-pixel 110.

In step S172, the picture displayed by the display panel 100 is acquired, and the acquired picture is compared with the first preset image to determine whether the first compensation parameter of each sub-pixel 110 satisfies the requirements. If it is determined that the first compensation parameter of each sub-pixel 110 does not satisfy the requirements, step S111 to step S130 are performed again.

In this way, it can be ensured that the first compensation parameter can accurately compensate the first type of picture, and that each sub-pixel 110 that satisfies the preset determination condition can accurately emit light after being compensated by the first compensation parameter.

The optical compensation calibration method of the present disclosure may further include the following steps.

In step S181, an initial gray level of each sub-pixel 110 of a second preset picture is input to the driver 200. The driver 200 compensates the initial gray level of each sub-pixel 110 of the second preset picture based on the second compensation parameter of each sub-pixel 110 to acquire the target gray level of each sub-pixel 110. The driver 200 lights up the display panel 100 based on the target gray level of each sub-pixel 110.

In step S182, the picture displayed by the display panel 100 is acquired, and the acquired picture is compared with the second preset image to determine whether the second compensation parameter of each sub-pixel 110 satisfies the requirements. If it is determined that the second compensation parameter of each sub-pixel 110 does not satisfy the requirements, step S141 to step S160 are performed again.

In this way, it can be ensured that the second compensation parameter can accurately compensate the second type of picture, and that each sub-pixel 110 that does not satisfy the preset determination condition can accurately emit light after being compensated by the second compensation parameter.

Figure 17:
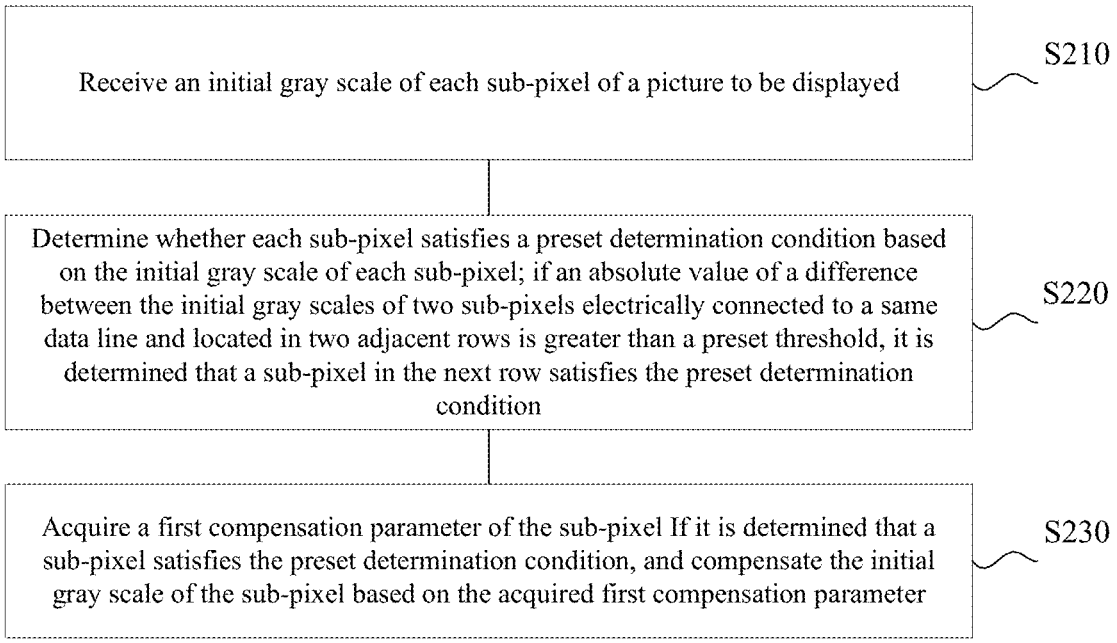
FIG. 17 is a schematic flowchart of an optical compensation method for a display device of the present disclosure.

The present disclosure further provides an optical compensation method for a display device. As shown in FIG. 1, the display device includes a driver 200 and a display panel 100, and the display panel 100 includes a plurality of sub-pixels 110 arranged in an array. As shown in FIG. 17, the optical compensation method includes the following steps.

In step S210, the initial gray level of each sub-pixel 110 of the picture to be displayed is received.

In step S220, based on the initial gray level of each sub-pixel 110, it is determined whether each sub-pixel 110 satisfies the preset determination condition.

In step S230, if it is determined that a certain sub-pixel 110 satisfies the preset determination condition, the first compensation parameter of the sub-pixel 110 is acquired, and the initial gray level of the sub-pixel 110 is compensated based on the acquired first compensation parameter to acquire the target gray level of the sub-pixel 110.

According to the optical compensation method for the display device of the present disclosure, when it is determined that the sub-pixel 110 satisfies the preset determination condition based on the initial gray level of the sub-pixel 110, it can be known that the data voltage changes greatly when the data line 120 charges the sub-pixel 110, and the sub-pixel 110 is prone to insufficient charging. The first compensation parameter of the sub-pixel 110 is exactly the compensation parameter acquired when the sub-pixel 110 satisfies the preset determination condition, and the sub-pixel 110 is compensated by the first compensation parameter to make the sub-pixel 110 display the correct luminance, and in turn, it is ensured that the sub-pixel 110 is charged to the correct potential, thereby avoiding the problem of insufficient charging occurring when the sub-pixel 110 satisfies the preset determination condition. As such, the optical compensation method of the present disclosure can directly compensate the initial gray level of the sub-pixel 110 of the picture to be displayed, avoiding the problem of insufficient charging occurring when the sub-pixel 110 satisfies the preset determination condition, and improving the compensation efficiency for the sub-pixel 110.

Next, each step of the optical compensation method for the display device of the present disclosure will be further explained and illustrated.

In step S210, the driver 200 may receive the initial gray level of each sub-pixel 110 of the picture to be displayed by the data receiving circuit 210. Optionally, the data receiving circuit 210 may include a data interface circuit and a picture detection (PD) circuit provided on the timing controller 201. The data interface circuit is configured to exchange data with the external of the display device, especially to receive the display data of the image to be displayed input to the display device from the external. The picture detection circuit is electrically connected to the data interface circuit, and is configured to acquire the initial gray level of each sub-pixel 110 of the image to be displayed according to the display data.

In step S220, it can be determined whether the sub-pixel 110 satisfies the preset determination condition according to the following principle: for two sub-pixels 110 electrically connected to the same data line 120 and located in two adjacent rows, if the absolute value of the difference between the initial gray levels of the two sub-pixels 110 exceeds a preset threshold, it can be considered that the sub-pixel 110 in the next row satisfies the preset determination condition, that is, when the data line 120 charges the sub-pixel 110 in the next row, the amplitude of the data voltage changes greatly, which may easily lead to insufficient charging of the sub-pixel 110 in the next row. It can be understood that the sub-pixel 110 in the next row is the sub-pixel 110 that is charged later in the charging sequence.

It can be understood that when the sub-pixels 110 on the display panel 100 are arranged in different ways, a specific sub-pixel 110 of the picture to be displayed may meet the preset determination condition on one type of display panel 100, and not meet the preset determination condition on another type of display panel 100.

In the following, several different types of display panels 100, and the preset determination condition corresponding to each type display panel 100 are exemplified to further explain and illustrate the preset determination condition.

In an embodiment of the present disclosure, as shown in FIG. 4, in the display panel 100, sub-pixels 110 in the same column are connected to the same data line 120, and one data line 120 is connected to one column of sub-pixels 110. In this type of the display panel 100, among the sub-pixels 110 in the same column, if the absolute value of the difference between the initial gray level of the sub-pixel 110 in the next row and the initial gray level of the sub-pixel 110 in the previous row exceeds the preset threshold, then the sub-pixel 110 in the next row satisfies the preset determination condition.

Therefore, in step S220, it can be determined whether any sub-pixel 110 in the next row satisfies the preset determination condition in the following method:

the absolute value of the difference between the initial gray level of the sub-pixel 110 in the next row and the initial gray level of the sub-pixel 110 in the previous row is calculated;

if the absolute value of the difference is greater than the preset threshold, it is determined that the sub-pixel 110 in the next row satisfies the preset determination condition.

Optionally, if the absolute value of the difference is not greater than the preset threshold, it is determined that the sub-pixel 110 in the next row does not satisfy the preset determination condition.

In another embodiment of the present disclosure, as shown in FIG. 5, among sub-pixels 110 in two adjacent columns, the sub-pixels 110 in odd-numbered rows and in one column of the two adjacent columns as well as the sub-pixels 110 in even-numbered rows and in another column of the two adjacent columns are connected to the same data line 120. The sub-pixel 110 P(i, 2j) and the sub-pixel 110 P(i+1, 2j−1) are connected to the data line 120 L(i+1), the data line 120 L(i+1) is a (i+1)th data line 120, the sub-pixel 110 P(i, 2j) is a sub-pixel 110 located in a i-th column and a 2j-th row, and the sub-pixel 110 P(i+1, 2j−1) is a sub-pixel 110 located in a (i+1)th column and a (2j−1)th row, where i is a positive integer greater than 0 and j is a positive integer greater than 0.

In this type of display panel 100, it is determined whether each sub-pixel 110 satisfies a preset determination condition by:

calculating the absolute value of the difference between G(i, 2j) and G(i+1, 2j−1), if the absolute value of the difference between G(i, 2j) and G(i+1, 2j−1) is greater than the preset threshold, it is determined that the sub-pixel 110 P(i, 2j) satisfies the preset determination condition;

calculating the absolute value of the difference between G(i+1, 2j+1) and G(i, 2j), if the absolute value of the difference between G(i+1, 2j+1) and G(i, 2j) is greater than the preset threshold, it is determined that the sub-pixel 110 P(i+1, 2j+1) satisfies the preset determination condition;

G(i, 2j) is the initial gray level of the sub-pixel 110 P(i, 2j), G(i+1, 2j−1) is the initial gray level of the sub-pixel 110 P(i+1, 2j−1), G(i+1, 2j+1) is the initial gray level of the sub-pixel 110 P(i+1, 2j+1).

Optionally, if the absolute value of the difference between G(i, 2j) and G(i+1, 2j−1) is not greater than the preset threshold, it is determined that the sub-pixel 110 P(i, 2j) does not satisfy the preset determination condition.

Optionally, if the absolute value of the difference between G(i+1, 2j+1) and G(i, 2j) is not greater than the preset threshold, it is determined that the sub-pixel 110 P(i+1, 2j+1) does not satisfy the preset determination condition.

In another embodiment of the present disclosure, as shown in FIG. 6, in the display panel 100, among sub-pixels 110 in two adjacent columns, the sub-pixels 110 in odd-numbered rows and in one column of the two adjacent columns as well as the sub-pixels 110 in even-numbered rows and in another column of the two adjacent columns are connected to the same data line 120. The sub-pixel 110 P(i, 2j−1) and the sub-pixel 110 P(i+1, 2j) are connected to the data line 120 L(i+1), the data line 120 L(i+1) is a (i+1)th data line 120, the sub-pixel 110 P(i, 2j−1) is a sub-pixel 110 located in a i-th column and a (2j−1)th row, and the sub-pixel 110 P(i+1, 2j) is a sub-pixel 110 located in a (i+1)th column and a 2j-th row, where i is a positive integer greater than 0 and j is a positive integer greater than 0.

In this type of display panel 100, it is determined whether each sub-pixel 110 satisfies the preset determination condition according to the initial gray level of each sub-pixel 110 by:

calculating the absolute value of the difference between G(i+1, 2j) and G(i, 2j−1), if the absolute value of the difference between G(i+1, 2j) and G(i, 2j−1) is greater than the preset threshold, it is determined that the sub-pixel 110 P(i+1, 2j) satisfies the preset determination condition;

calculating the absolute value of the difference between G(i, 2j+1) and G(i+1, 2j), if the absolute value of the difference between G(i, 2j+1) and G(i+1, 2j) is greater than the preset threshold, it is determined that the sub-pixel 110 P(i, 2j+1) satisfies the preset determination condition;

G(i, 2j−1) is the initial gray level of the sub-pixel 110 P(i, 2j−1), G(i+1, 2j) is the initial gray level of the sub-pixel 110 P(i+1, 2j), G(i, 2j+1) is the initial gray level of the sub-pixel 110 P(i, 2j+1).

Optionally, if the absolute value of the difference between G(i+1, 2j) and G(i, 2j−1) is not greater than the preset threshold, it is determined that the sub-pixel 110 P(i+1, 2j) does not meet the preset determination condition.

Optionally, if the absolute value of the difference between G(i, 2j+1) and G(i+1, 2j) is not greater than the preset threshold, it is determined that the sub-pixel 110 P(i, 2j+1) does not meet the preset determination condition.

In an embodiment of the present disclosure, the first compensation parameter may be a gray level difference value, where the gray level difference value may be a positive value, a negative value, or 0. When the initial gray value of the sub-pixel 110 is compensated by the first compensation parameter, the sum of the initial gray level of the sub-pixel 110 and the first compensation parameter can be calculated as the target gray level of the sub-pixel 110.

The optical compensation method of the present disclosure may further include the following steps.

In step S240, if it is determined that a certain sub-pixel 110 does not satisfy the preset determination condition, the second compensation parameter of the sub-pixel 110 is acquired, and the initial gray level of the sub-pixel 110 is compensated based on the acquired second compensation parameter to acquire the target gray level of the sub-pixel 110.

The second compensation parameter of the sub-pixel 110 is a compensation parameter acquired by performing optical compensation calibration with respect to the second type of picture. In the second type of picture, the sub-pixel 110 does not satisfy the preset determination condition. Therefore, when it is determined that the sub-pixel 110 does not satisfy the preset determination condition, the initial gray level of the sub-pixel 110 is compensated by the second compensation parameter, so that the sub-pixel 110 can emit light correctly, thereby ensuring that the sub-pixel 110 can be accurately charged to the expected potential when the preset determination condition is not met, to avoid the sub-pixel 110 being undercharged when the preset determination condition is not met.

In an embodiment of the present disclosure, the second compensation parameter may be a gray level difference value, where the gray level difference value may be a positive value, a negative value, or zero (0). When the initial gray value of the sub-pixel 110 is compensated by the second compensation parameter, the sum of the initial gray level of the sub-pixel 110 and the second compensation parameter can be calculated as the target gray level of the sub-pixel 110.

The optical compensation calibration method of the present disclosure may further include the following step.

In step S250, the display panel 100 is driven to display the picture according to the target gray level of each sub-pixel 110.

In this way, since each sub-pixel 110 has undergone optical compensation, each sub-pixel 110 can accurately emit light, avoiding the problem of insufficient charging of each sub-pixel 110.

It should be noted that although the various steps of the method of the present disclosure are described in a particular order in the figures, this is not required or implied that the steps must be performed in the specific order, or all the steps shown must be performed to achieve the desired result. Additionally or alternatively, certain steps may be omitted, multiple steps may be combined into one step, and/or one step may be decomposed into multiple steps and so on, all of which shall be considered as part of the present disclosure.

The present disclosure further provides a driver 200. As shown in FIG. 1, the driver 200 is configured to drive a display panel 100, and the display panel 100 includes sub-pixels 110 arranged in an array. As shown in FIG. 18, the driver 200 may include a data receiving circuit 210, a determination circuit 220, a first compensation parameter storage circuit 230, and a first execution circuit 240.

The data receiving circuit 210 is configured to receive an initial gray level of each sub-pixel 110 of a picture to be displayed. The determination circuit 220 is electrically connected to the data receiving circuit 210 and is configured to determine whether each sub-pixel 110 satisfies a preset determination condition based on the initial gray level of each sub-pixel 110. The first compensation parameter storage circuit 230 is configured to store a first compensation parameter of each sub-pixel 110. The first execution circuit 240 is electrically connected to the determination circuit 220 and the first compensation parameter storage circuit 230, and is configured to, when it is determined that a sub-pixel 110 satisfies the preset determination condition, acquire the first compensation parameter of the sub-pixel 110, and compensate the initial gray level of the sub-pixel 110 based on the acquired first compensation parameter.

The driver 200 provided by the present disclosure can acquire the initial gray level of each sub-pixel 110 of the picture to be displayed, determine whether each sub-pixel 110 satisfies a preset determination condition, and acquire the first compensation parameter of the sub-pixel 110, when it is determined that a sub-pixel 110 satisfies the preset determination condition, and compensate the initial gray level of the sub-pixel 110 based on the acquired first compensation parameter. When it is determined that the sub-pixel 110 satisfies the preset determination condition based on the initial gray level of the sub-pixel 110, it can be known that the data voltage changes greatly when the data line 120 charges the sub-pixel 110, and the sub-pixel 110 is prone to insufficient charging. The first compensation parameter of the sub-pixel 110 is exactly the compensation parameter acquired when the sub-pixel 110 satisfies the preset determination condition, and the sub-pixel 110 is compensated by the first compensation parameter to make the sub-pixel 110 display the correct luminance, and in turn, it is ensured that the sub-pixel 110 is charged to the correct potential, thereby avoiding the problem of insufficient charging occurring when the sub-pixel 110 satisfies the preset determination condition. As such, the driver 200 of the present disclosure can directly compensate the initial gray level of the sub-pixel 110 of the picture to be displayed, avoiding the problem of insufficient charging occurring when the sub-pixel 110 satisfies the preset determination condition, and improving the compensation efficiency for the sub-pixel 110.

In the following, each circuit of the driver 200 of the present disclosure will be further explained and illustrated with reference to the drawings.

The data receiving circuit 210 is configured to receive the initial gray level of each sub-pixel 110 of the picture to be displayed. Optionally, the data receiving circuit 210 may include a data interface circuit and a picture detection (PD) circuit provided on the timing controller 201. The data interface circuit is configured to exchange data with the external of the display device, especially to receive the display data of the image to be displayed input to the display device from the external; the picture detection circuit is electrically connected to the data interface circuit, and is configured to acquire the initial gray level of each sub-pixel 110 of the image to be displayed based on the display data.

The determination circuit 220 is configured to determine whether each sub-pixel 110 satisfies a preset determination condition. The determination circuit 220 can determine whether the sub-pixel 110 satisfies the preset determination condition according to the following principle: for two sub-pixels 110 electrically connected to the same data line 120 and located in two adjacent rows, if the absolute value of the difference between the initial gray levels of the two sub-pixels 110 exceeds a preset threshold, it can be considered that the sub-pixels 110 in the next row satisfies the preset determination condition, that is, the amplitude of the data voltage changes greatly when the data line 120 charges the sub-pixel 110 in the next row, which may easily lead to insufficient charging of the sub-pixel 110 in the next row. It can be understood that the sub-pixel 110 in the next row is the sub-pixel 110 that is charged later in the charging sequence.

It can be understood that when the sub-pixels 110 on the display panel 100 are arranged in different ways, the determination circuit 220 may be different. In the following, several different types of display panels 100, and the determination circuit 220 corresponding to each type of display panel 100 are exemplified to further explain and illustrate the preset determination condition.

In an embodiment of the present disclosure, as shown in FIG. 4, in the display panel 100, sub-pixels 110 in the same column are connected to the same data line 120, and one data line 120 is connected to one column of sub-pixels 110. In this type of the display panel 100, among the sub-pixels 110 in the same column, if the absolute value of the difference between the initial gray level of the sub-pixel 110 in the next row and the initial gray level of the sub-pixel 110 in the previous row exceeds the preset threshold, then the sub-pixel 110 in the next row satisfies the preset determination condition.

Corresponding to this type of display panel 100, the determination circuit 220 is configured to:

determine whether each sub-pixel 110 satisfies the preset determination condition; and the method for determining whether any sub-pixel 110 in the next row satisfies the preset determination condition includes:

calculating the absolute value of the difference between the initial gray level of the sub-pixel 110 in the next row and the initial gray level of the sub-pixel 110 in the previous row; and determining that the sub-pixel 110 in the next row satisfies the preset determination condition, if the absolute value of the difference is greater than the preset threshold.

Optionally, the determination circuit 220 may be further configured to: if the absolute value of the difference is not greater than the preset threshold, determine that the sub-pixel 110 in the next row does not satisfy the preset determination condition.

In another embodiment of the present disclosure, as shown in FIG. 5, in the display panel 100, among sub-pixels 110 in two adjacent columns, the sub-pixels 110 in odd-numbered rows and in one column of the two adjacent columns as well as the sub-pixels 110 in even-numbered rows and in another column of the two adjacent columns are connected to the same data line 120. The sub-pixel 110 P(i, 2j) and the sub-pixel 110 P(i+1, 2j−1) are connected to the data line 120 L(i+1), the data line 120 L(i+1) is a (i+1)th data line 120, the sub-pixel 110 P(i, 2j) is a sub-pixel 110 located in a i-th column and a 2j-th row, and the sub-pixel 110 P(i+1, 2j−1) is a sub-pixel 110 located in a (i+1)th column and a (2j−1)th row, where i is a positive integer greater than 0 and j is a positive integer greater than 0

Corresponding to this type of display panel 100, the determination circuit 220 is configured to:

calculate the absolute value of the difference between G(i, 2j) and G(i+1, 2j−1), if the absolute value of the difference between G(i, 2j) and G(i+1, 2j−1) is greater than the preset threshold, it is determined that the sub-pixel 110 P(i, 2j) satisfies the preset determination condition;

calculate the absolute value of the difference between G(i+1, 2j+1) and G(i, 2j), if the absolute value of the difference between G(i+1, 2j+1) and G(i, 2j) is greater than the preset threshold, it is determined that the sub-pixel 110 P(i+1, 2j+1) satisfies the preset determination condition;

G(i, 2j) is the initial gray level of the sub-pixel 110 P(i, 2j), G(i+1, 2j−1) is the initial gray level of the sub-pixel 110 P(i+1, 2j−1), G(i+1, 2j+1) is the initial gray level of the sub-pixel 110 P(i+1, 2j+1).

Optionally, the determination circuit 220 may be further configured to: if the absolute value of the difference between G(i, 2j) and G(i+1, 2j−1) is not greater than the preset threshold, determine that the sub-pixel 110 P(i, 2j) does not satisfy the preset determination condition.

Optionally, the determination circuit 220 may be further configured to: if the absolute value of the difference between G(i+1, 2j+1) and G(i, 2j) is not greater than the preset threshold, determine that the sub-pixel 110 P(i+1, 2j+1) does not satisfy the preset determination condition.

In another embodiment of the present disclosure, as shown in FIG. 6, in the display panel 100, among sub-pixels 110 in two adjacent columns, the sub-pixels 110 in odd-numbered rows and in one column of the two adjacent columns as well as the sub-pixels 110 in even-numbered rows and in another column of the two adjacent columns are connected to the same data line 120. The sub-pixel 110 P(i, 2j−1) and the sub-pixel 110 P(i+1, 2j) are connected to the data line 120 L(i+1), the data line 120 L(i+1) is a (i+1)th data line 120, the sub-pixel 110 P(i, 2j−1) is a sub-pixel 110 located in a i-th column and a (2j−1)th row, and the sub-pixel 110 P(i+1, 2j) is a sub-pixel 110 located in a (i+1)th column and a 2j-th row, where i is a positive integer greater than 0 and j is a positive integer greater than 0.

Corresponding to this type of display panel 100, the determination circuit 220 is configured to:

calculate the absolute value of the difference between G(i+1, 2j) and G(i, 2j−1), if the absolute value of the difference between G(i+1, 2j) and G(i, 2j−1) is greater than the preset threshold, it is determined that the sub-pixel 110 P(i+1, 2j) satisfies the preset determination condition;

calculate the absolute value of the difference between G(i, 2j+1) and G(i+1, 2j), if the absolute value of the difference between G(i, 2j+1) and G(i+1, 2j) is greater than the preset threshold, it is determined that the sub-pixel 110 P(i, 2j+1) satisfies the preset determination condition;

G(i, 2j−1) is the initial gray level of the sub-pixel 110 P(i, 2j−1), G(i+1, 2j) is the initial gray level of the sub-pixel 110 P(i+1, 2j), G(i, 2j+1) is the initial gray level of the sub-pixel 110 P(i, 2j+1).

Optionally, the determination circuit 220 may be further configured to: if the absolute value of the difference between G(i+1, 2j) and G(i, 2j−1) is not greater than the preset threshold, determine that the sub-pixel 110 P(i+1, 2j) does not meet the preset determination condition Optionally, the determination circuit 220 may be further configured to: if the absolute value of the difference between G(i, 2j+1) and G(i+1, 2j) is not greater than the preset threshold, determine that the sub-pixel 110 P(i, 2j+1) does not meet the preset determination condition.

In another embodiment of the present disclosure, the first compensation parameter may be a gray level difference value, where the gray level difference value may be a positive value, a negative value, or 0. The first execution circuit may be configured to, when it is determined that a sub-pixel 110 satisfies the preset determination condition, acquire the first compensation parameter of the sub-pixel 110, and calculate the sum of the first compensation parameter of the sub-pixel 110 and the initial gray level of the sub-pixel 110 as the target gray level of the sub-pixel 110.

As shown in FIG. 18, the driver 200 of the present disclosure may further include a second compensation parameter storage circuit 250 and a second execution circuit 260. The second compensation parameter storage circuit 250 is configured to store the second compensation parameter of each sub-pixel 110. The second execution circuit 260 is electrically connected to the determination circuit 220 and the second compensation parameter storage circuit 250, and is configured to acquire the second compensation parameter of the sub-pixel 110, and compensate the initial gray level of the sub-pixel 110 according to the acquired second compensation parameter when it is determined that a sub-pixel 110 does not satisfy the preset determination condition.

In another embodiment of the present disclosure, the second compensation parameter may be a gray level difference value, where the gray level difference value may be a positive value, a negative value, or 0. The second execution circuit may be configured to, when it is determined that a sub-pixel 110 does not satisfy the preset determination condition, acquire the second compensation parameter of the sub-pixel 110, and calculate the sum of the second compensation parameter of the sub-pixel 110 and the initial gray level of the sub-pixel 110 as the target gray level of the sub-pixel 110.

The second compensation parameter of the sub-pixel 110 is a compensation parameter acquired by performing optical compensation calibration according to the second type of picture. In the second type of picture, the sub-pixel 110 does not satisfy the preset determination condition. Therefore, when it is determined that the sub-pixel 110 does not satisfy the preset determination condition, the initial gray level of the sub-pixel 110 is compensated by the second compensation parameter, so that the sub-pixel 110 can emit light correctly, thereby ensuring that the sub-pixel 110 can be accurately charged to the expected potential when the preset determination condition is not met, to avoid the sub-pixel 110 being undercharged when the preset determination condition is not met.

In an embodiment of the present disclosure, the first execution circuit 240 and the second execution circuit 260 may be the same execution circuit. For example, the execution circuit may include a selection sub-circuit and a compensation sub-circuit.

The selection sub-circuit is electrically connected to the determination circuit 220, the first compensation parameter storage circuit 230, and the second compensation parameter storage circuit 250, and the selection sub-circuit is configured to: receive the initial gray level and determination result of the sub-pixel 110 sent by the determination circuit 220; when the determination result is that the sub-pixel 110 satisfies the preset determination condition, acquire the first compensation parameter of the sub-pixel 110 from the first compensation parameter storage circuit 230; when the determination result is that the sub-pixel 110 does not meet the preset determination condition, acquire the second compensation parameter of the sub-pixel 110 from the second compensation parameter storage circuit 250; and output the initial gray level and the first compensation parameter or the second compensation parameter of the sub-pixel 110.

The compensation sub-circuit is electrically connected to the selection sub-circuit, and is configured to: receive the initial gray level and the first compensation parameter or the second compensation parameter of the sub-pixel 110, and according to the first compensation parameter or the second compensation parameter, compensate the initial gray level of the sub-pixel 110 to acquire the target gray level of the sub-pixel 110.

The driver 200 of the present disclosure may also perform other forms of compensation on the target gray level of the sub-pixel 110, such as gamma compensation, etc., and drive the display panel 100 to display a screen according to the compensation result.

Embodiments of the present disclosure further provide a display device. As shown in FIG. 1, the display device includes any driver 200 described in the above driver embodiment. The display device may be a mobile phone screen, a television, a smart watch screen, or other types of display devices. Since the display device has any of the drivers described in the above-mentioned driver embodiments, it has the same beneficial effects, and the disclosure is not repeated here.

It should be understood that the present disclosure is not limited to the detailed structure and arrangement of the components proposed by the present specification. The present disclosure is capable of having other embodiments, and be carried out and implemented in various manners. The foregoing variations and modifications fall within the scope of the present disclosure. It should be understood that the present disclosure disclosed and defined by the present specification extends to all alternative combinations of two or more of the individual features apparent or recited herein and/or in the drawings. All of these various combinations constitute a number of alternative aspects of the present disclosure. The embodiments described in the present specification are illustrative of the best mode for carrying out the present disclosure and will enable those skilled in the art to utilize the present disclosure.

What is claimed is:

1. An optical compensation method for a display device, comprising:

providing the display device, wherein the display device comprises a driver and a display panel, and the display panel comprises a plurality of sub-pixels arranged in an array;

receiving an initial gray level of each sub-pixel of a picture to be displayed;

determining whether each sub-pixel satisfies a preset determination condition based on the initial gray level of each sub-pixel, wherein if an absolute value of a difference between the initial gray levels of two sub-pixels electrically connected to a same data line and located in two adjacent rows is greater than a preset threshold, it is determined that the sub-pixel in a next row satisfies the preset determination condition, wherein the sub-pixel in the next row is the sub-pixel in the two sub-pixels that is charged later in a charging sequence; and in response to determining that a sub-pixel satisfies the preset determination condition, acquiring a first compensation parameter of the sub-pixel, and compensating the initial gray level of the sub-pixel based on the acquired first compensation parameter, wherein:

the first compensation parameter is a gray level difference value; and compensating the initial gray level of the sub-pixel based on the acquired first compensation parameter comprises calculating a sum of the acquired first compensation parameter and the initial gray level of the sub-pixel to obtain a target gray level of the sub-pixel.

2. The optical compensation method for the display device according to claim 1, wherein:

in the display panel, the sub-pixels in a same column are connected to a same data line;

it is determined whether any sub-pixel in the next row satisfies the preset determination condition by:

calculating an absolute value of a difference between the initial gray levels of the sub-pixel in the next row and a sub-pixel in a previous row, wherein the sub-pixel in the previous row is the sub-pixel that is first charged in the charging sequence; and determining that the sub-pixel in the next row satisfies the preset determination condition if the absolute value of the difference is greater than the preset threshold.

3. The optical compensation method for the display device according to claim 1, wherein:

in the display panel, a sub-pixel P(i, 2j), a sub-pixel P(i+1, 2j−1), and a sub-pixel P(i+1, 2j+1) are connected to a data line L(i+1), wherein the data line L(i+1) is a (i+1)th data line, the sub-pixel P(i, 2j) is a sub-pixel located in a i-th column and a 2j-th row, the sub-pixel P(i+1, 2j−1) is a sub-pixel located in a (i+1)th column and a (2j−1)th row, and the sub-pixel P(i+1, 2j+1) is a sub-pixel located in a (i+1)th column and a (2j+1)th row, where i is a positive integer greater than 0 and j is a positive integer greater than 0; and determining whether each sub-pixel satisfies a preset determination condition based on the initial gray level of each sub-pixel comprises:

calculating an absolute value of a difference between G(i, 2j) and G(i+1, 2j−1) and, if the absolute value of the difference between G(i, 2j) and G(i+1, 2j−1) is greater than the preset threshold, determining that the sub-pixel P(i, 2j) satisfies the preset determination condition; and calculating an absolute value of a difference between G(i+1, 2j+1) and G(i, 2j) and, if the absolute value of the difference between G(i+1, 2j+1) and G(i, 2j) is greater than the preset threshold, determining that the sub-pixel P(i+1, 2j+1) satisfies the preset determination condition;

wherein G(i, 2j) is the initial gray level of the sub-pixel P(i, 2j), G(i+1, 2j−1) is the initial gray level of the sub-pixel P(i+1, 2j−1), and G(i+1, 2j+1) is the initial gray level of the sub-pixel P(i+1, 2j+1).

4. The optical compensation method for the display device according to claim 1, wherein:

in the display panel, a sub-pixel P(i, 2j−1), a sub-pixel P(i+1, 2j), and a sub-pixel P(i, 2j+1) are connected to a data line L(i+1), where the data line L(i+1) is the (i+1)th data line, the sub-pixel P(i, 2j−1) is a sub-pixel located in the i-th column and the (2j−1)th row, the sub-pixel P(i+1, 2j) is a sub-pixel located in the (i+1)th column and the 2j-th row, and the sub-pixel P(i, 2j+1) is a sub-pixel located in the i-th column and the (2j+1)-th row, where i is a positive integer greater than 0 and j is a positive integer greater than 0;

determining whether each sub-pixel satisfies a preset determination condition based on the initial gray level of each sub-pixel comprises:

calculating an absolute value of a difference between G(i+1, 2j) and G(i, 2j−1), if the absolute value of the difference between G(i+1, 2j) and G(i, 2j−1) is greater than the preset threshold, determining that the sub-pixel P(i+1, 2j) satisfies the preset determination condition; and calculating an absolute value of a difference between G(i, 2j+1) and G(i+1, 2j), if the absolute value of the difference between G(i, 2j+1) and G(i+1, 2j) is greater than the preset threshold, determining that the sub-pixel P(i, 2j+1) satisfies the preset determination condition;

wherein G(i, 2j−1) is the initial gray level of the sub-pixel P(i, 2j−1), G(i+1, 2j) is the initial gray level of the sub-pixel P(i+1, 2j), and G(i, 2j+1) is the initial gray level of the sub-pixel P(i, 2j+1).

5. The optical compensation method for the display device according to claim 1, further comprising:

inputting the initial gray level of each sub-pixel of a first preset picture to the driver, wherein, in the first preset picture, an absolute value of a difference between the initial gray levels of any two sub-pixels electrically connected to the same data line and located in two adjacent rows is greater than the preset threshold;

acquiring an initial luminance of each sub-pixel in the display panel;

determining the first compensation parameter of each sub-pixel based on the initial gray level of each sub-pixel and the initial luminance of each sub-pixel; and storing the first compensation parameter of each sub-pixel in the driver.

6. The optical compensation method for the display device according to claim 5, wherein:

in the display panel, the sub-pixels in the same column are connected to the same data line; and among any same column of sub-pixels in the first preset picture, the absolute value of the difference between the initial gray levels of the sub-pixels in any two adjacent rows is greater than the preset threshold.

7. The optical compensation method for the display device according to claim 5, wherein:

in the display panel, a sub-pixel P(i, 2j), a sub-pixel P(i+1, 2j−1), and a sub-pixel P(i+1, 2j+1) are connected to a data line L(i+1), where the data line L(i+1) is the (i+1)th data line, the sub-pixel P(i, 2j) is a sub-pixel located in the i-th column and the 2j-th row, the sub-pixel P(i+1, 2j−1) is a sub-pixel located in the (i+1)th column and the (2j−1)th row, and the sub-pixel P(i+1, 2j+1) is a sub-pixel located in the (i+1)th column and the (2j+1)th row, where i is a positive integer greater than 0 and j is a positive integer greater than 0; and in the first preset picture, the absolute value of the difference between G(i, 2j) and G(i+1, 2j−1) is greater than the preset threshold, and the absolute value of the difference between G(i, 2j) and G(i+1, 2j+1) is greater than the preset threshold, wherein G(i, 2j) is the initial gray level of the sub-pixel P(i, 2j), G(i+1, 2j−1) is the initial gray level of the sub-pixel P(i+1, 2j−1), and G(i+1, 2j+1) is the initial gray level of the sub-pixel P(i+1, 2j+1).

8. The optical compensation method for the display device according to claim 5, wherein:

in the display panel, a sub-pixel P(i, 2j−1), a sub-pixel P(i+1, 2j), and a sub-pixel P(i, 2j+1) are connected to a data line L(i+1), where the data line L(i+1) is the (i+1)th data line, the sub-pixel P(i, 2j−1) is a sub-pixel located in the i-th column and the (2j−1)th row, the sub-pixel P(i+1, 2j) is a sub-pixel located in the (i+1)th column and the 2j-th row, and the sub-pixel P(i, 2j+1) is a sub-pixel located in the i-th column and the (2j+1)-th row, where i is a positive integer greater than 0 and j is a positive integer greater than 0; and in the first preset picture, the absolute value of the difference between G(i, 2j−1) and G(i+1, 2j) is greater than the preset threshold, and the absolute value of the difference between G(i, 2j+1) and G(i+1, 2j) is greater than the preset threshold, wherein G(i, 2j−1) is the initial gray level of the sub-pixel P(i, 2j−1), G(i+1, 2j) is the initial gray level of the sub-pixel P(i+1, 2j), and G(i, 2j+1) is the initial gray level of the sub-pixel P(i, 2j+1).

9. The optical compensation method for the display device according to claim 5, wherein:

the driver comprises a timing controller; and storing the first compensation parameter of each sub-pixel in the driver comprises storing the first compensation parameter of each sub-pixel in the timing controller.

10. The optical compensation method for the display device according to claim 1, further comprising, in response to determining that a sub-pixel does not satisfy the preset determination condition, acquiring a second compensation parameter of the sub-pixel, and compensating the initial gray level of the sub-pixel based on the acquired second compensation parameter.

11. The optical compensation method for the display device according to claim 10, further comprising:

inputting the initial gray level of each sub-pixel of a second preset picture to the driver, wherein, in the second preset picture, an absolute value of a difference between the initial gray levels of any two sub-pixels electrically connected to the same data line and located in two adjacent rows does not exceed the preset threshold;

acquiring an initial luminance of each sub-pixel in the display panel;

determining the second compensation parameter of each sub-pixel based on the initial gray level of each sub-pixel and the initial luminance of each sub-pixel; and storing the second compensation parameter of each sub-pixel in the driver.

12. A driver for driving a display panel, wherein the display panel comprises sub-pixels arranged in an array, and the driver comprises:

a data receiving circuit configured to receive an initial gray level of each sub-pixel of a picture to be displayed;

a determination circuit electrically connected to the data receiving circuit, and configured to determine whether each sub-pixel satisfies a preset determination condition based on the initial gray level of each sub-pixel, wherein, if an absolute value of a difference between the initial gray levels of two sub-pixels electrically connected to a same data line and located in two adjacent rows is greater than a preset threshold, it is determined that the sub-pixel in a next row satisfies the preset determination condition, and wherein the sub-pixel in the next row is the sub-pixel in the two sub-pixels that is charged later in a charging sequence;

a first compensation parameter storage circuit configured to store a first compensation parameter of each sub-pixel; and a first execution circuit electrically connected to the determination circuit and the first compensation parameter storage circuit, and configured to, when it is determined that a sub-pixel satisfies the preset determination condition, acquire the first compensation parameter of the sub-pixel and compensate the initial gray level of the sub-pixel based on the acquired first compensation parameter, wherein:

the first compensation parameter is a gray level difference value; and the first execution circuit is configured to calculate a sum of the acquired first compensation parameter and the initial gray level of the sub-pixel to obtain a target gray level of the sub-pixel, so as to compensate the initial gray level of the sub-pixel based on the acquired first compensation parameter.

13. The driver according to claim 12, wherein:

in the display panel, the sub-pixels in a same column are connected to a same data line;

the determination circuit is configured to determine whether each sub-pixel satisfies the preset determination condition, wherein it is determined whether any sub-pixel in the next row satisfies the preset determination condition by:

calculating an absolute value of a difference between the initial gray levels of the sub-pixel in the next row and a sub-pixel in a previous row, wherein the sub-pixel in the previous row is the sub-pixel that is first charged in the charging sequence; and determining that the sub-pixel in the next row satisfies the preset determination condition if the absolute value of the difference is greater than the preset threshold.

14. The driver according to claim 12, wherein:

in the display panel, a sub-pixel P(i, 2j), a sub-pixel P(i+1, 2j−1), and a sub-pixel P(i+1, 2j+1) are connected to a data line L(i+1), where the data line L(i+1) is the (i+1)th data line, the sub-pixel P(i, 2j) is a sub-pixel located in the i-th column and the 2j-th row, the sub-pixel P(i+1, 2j−1) is a sub-pixel located in the (i+1)th column and the (2j−1)th row, and the sub-pixel P(i+1, 2j+1) is a sub-pixel located in the (i+1)th column and the (2j+1)th row, where i is a positive integer greater than 0 and j is a positive integer greater than 0;

the determination circuit is configured to:

calculate an absolute value of a difference between G(i, 2j) and G(i+1, 2j−1), if the absolute value of the difference between G(i, 2j) and G(i+1, 2j−1) is greater than the preset threshold, determine that the sub-pixel P(i, 2j) satisfies the preset determination condition; and calculate an absolute value of a difference between G(i+1, 2j+1) and G(i, 2j), if the absolute value of the difference between G(i+1, 2j+1) and G(i, 2j) is greater than the preset threshold, determine that the sub-pixel P(i+1, 2j+1) satisfies the preset determination condition;

wherein G(i, 2j) is the initial gray level of the sub-pixel P(i, 2j), G(i+1, 2j−1) is the initial gray level of the sub-pixel P(i+1, 2j−1), and G(i+1, 2j+1) is the initial gray level of the sub-pixel P(i+1, 2j+1).

15. The driver according to claim 12, wherein:

in the display panel, a sub-pixel P(i, 2j−1), a sub-pixel P(i+1, 2j), and a sub-pixel P(i, 2j+1) are connected to a data line L(i+1), where the data line L(i+1) is the (i+1)th data line, the sub-pixel P(i, 2j−1) is a sub-pixel located in the i-th column and the (2j−1)th row, the sub-pixel P(i+1, 2j) is a sub-pixel located in the (i+1)th column and the 2j-th row, the sub-pixel P(i, 2j+1) is a sub-pixel located in the i-th column and the (2j+1)-th row, where i is a positive integer greater than 0 and j is a positive integer greater than 0;

the determination circuit is configured to:

calculate an absolute value of a difference between G(i+1, 2j) and G(i, 2j−1) and, if the absolute value of the difference between G(i+1, 2j) and G(i, 2j−1) is greater than the preset threshold, determine that the sub-pixel the sub-pixel P(i+1, 2j) satisfies the preset determination condition; and calculate an absolute value of a difference between G(i, 2j+1) and G(i+1, 2j) and, if the absolute value of the difference between G(i, 2j+1) and G(i+1, 2j) is greater than the preset threshold, determine that the sub-pixel P(i, 2j+1) satisfies the preset determination condition;

wherein G(i, 2j−1) is the initial gray level of the sub-pixel P(i, 2j−1), G(i+1, 2j) is the initial gray level of the sub-pixel P(i+1, 2j), and G(i, 2j+1) is the initial gray level of the sub-pixel P(i, 2j+1).

16. The driver of claim 12, further comprising:

a second compensation parameter storage circuit configured to store a second compensation parameter of each sub-pixel; and a second execution circuit electrically connected to the determination circuit and the second compensation parameter storage circuit, and configured to, when it is determined that a sub-pixel does not satisfy the preset determination condition, acquire the second compensation parameter of the sub-pixel and compensate the initial gray level of the sub-pixel based on the acquired second compensation parameter.

17. A display device, comprising a driver and a display panel, wherein the driver is configured to drive the display panel, and the display panel comprises sub-pixels arranged in an array, wherein the driver comprises:

a data receiving circuit configured to receive an initial gray level of each sub-pixel of a picture to be displayed;

a determination circuit electrically connected to the data receiving circuit, and configured to determine whether each sub-pixel satisfies a preset determination condition based on the initial gray level of each sub-pixel, wherein, if an absolute value of a difference between the initial gray levels of two sub-pixels electrically connected to a same data line and located in two adjacent rows is greater than a preset threshold, it is determined that the sub-pixel in a next row satisfies the preset determination condition, and wherein the sub-pixel in the next row is the sub-pixel in the two sub-pixels that is charged later in a charging sequence;

a first compensation parameter storage circuit configured to store a first compensation parameter of each sub-pixel; and a first execution circuit electrically connected to the determination circuit and the first compensation parameter storage circuit, and configured to, when it is determined that a sub-pixel satisfies the preset determination condition, acquire the first compensation parameter of the sub-pixel and compensate the initial gray level of the sub-pixel based on the acquired first compensation parameter, wherein the first compensation parameter is a gray level difference value; and the first execution circuit is configured to calculate a sum of the acquired first compensation parameter and the initial gray level of the sub-pixel to obtain a target gray level of the sub-pixel, so as to compensate the initial gray level of the sub-pixel based on the acquired first compensation parameter.

18. The display device of claim 17, wherein:

in the display panel, the sub-pixels in a same column are connected to a same data line; and the determination circuit is configured to determine whether each sub-pixel satisfies the preset determination condition, wherein it is determined whether any sub-pixel in the next row satisfies the preset determination condition by:

calculating an absolute value of a difference between the initial gray levels of the sub-pixel in the next row and a sub-pixel in a previous row, wherein the sub-pixel in the previous row is the sub-pixel that is first charged in the charging sequence; and determining that the sub-pixel in the next row satisfies the preset determination condition if the absolute value of the difference is greater than the preset threshold.

19. The display device of claim 17, wherein:

in the display panel, a sub-pixel P(i, 2j), a sub-pixel P(i+1, 2j−1), and a sub-pixel P(i+1, 2j+1) are connected to a data line L(i+1), where the data line L(i+1) is the (i+1)th data line, the sub-pixel P(i, 2j) is a sub-pixel located in the i-th column and the 2j-th row, the sub-pixel P(i+1, 2j−1) is a sub-pixel located in the (i+1)th column and the (2j−1)th row, and the sub-pixel P(i+1, 2j+1) is a sub-pixel located in the (i+1)th column and the (2j+1)th row, where i is a positive integer greater than 0 and j is a positive integer greater than 0;

the determination circuit is configured to:

calculate an absolute value of a difference between G(i, 2j) and G(i+1, 2j−1) and, if the absolute value of the difference between G(i, 2j) and G(i+1, 2j−1) is greater than the preset threshold, determine that the sub-pixel P(i, 2j) satisfies the preset determination condition; and calculate an absolute value of a difference between G(i+1, 2j+1) and G(i, 2j) and, if the absolute value of the difference between G(i+1, 2j+1) and G(i, 2j) is greater than the preset threshold, determine that the sub-pixel P(i+1, 2j+1) satisfies the preset determination condition;

wherein G(i, 2j) is the initial gray level of the sub-pixel P(i, 2j), G(i+1, 2j−1) is the initial gray level of the sub-pixel P(i+1, 2j−1), and G(i+1, 2j+1) is the initial gray level of the sub-pixel P(i+1, 2j+1).

* * * * *